US006659370B1

(12) United States Patent
Inoue

(10) Patent No.: US 6,659,370 B1
(45) Date of Patent: Dec. 9, 2003

(54) LIQUID SPRAY DEVICE AND CUTTING METHOD

(75) Inventor: Tsutomu Inoue, Aichi (JP)

(73) Assignee: Fuji BC Engineering Co., Ltd., Aichi (JP)

( * ) Notice: Subject to any disclaimer, the term of this patent is extended or adjusted under 35 U.S.C. 154(b) by 0 days.

(21) Appl. No.: 09/700,830

(22) PCT Filed: Mar. 12, 1999

(86) PCT No.: PCT/JP99/01234

§ 371 (c)(1),
(2), (4) Date: Nov. 20, 2000

(87) PCT Pub. No.: WO99/61163

PCT Pub. Date: Dec. 2, 1999

(30) Foreign Application Priority Data

May 25, 1998 (JP) ..... 10-142592
Oct. 27, 1998 (JP) ..... 10-305694

(51) Int. Cl.[7] ..... F23D 11/16; F23D 11/40; F23D 11/10; B05B 7/06

(52) U.S. Cl. ..... 239/423; 239/419.5; 239/424.5; 239/463

(58) Field of Search ..... 239/423, 398, 239/432, 419, 419.5, 424.5, 418, 302, 368, 369, 366, 463, 494, 467, 523

(56) References Cited

U.S. PATENT DOCUMENTS

| | | | |
|---|---|---|---|
| 954,451 | A | 4/1910 | Merrell |
| 992,503 | A | 5/1911 | Howard |
| 1,333,451 | A | 3/1920 | Sample |

(List continued on next page.)

FOREIGN PATENT DOCUMENTS

| | | |
|---|---|---|
| EP | 0 539 055 | 10/1992 |
| EP | 0 941 769 | 9/1999 |
| FR | 1 152 856 | 2/1958 |
| GB | 465357 | 5/1937 |
| JP | 25-3045 | 8/1950 |
| JP | 53-53124 | 12/1978 |
| JP | 54-6762 | 3/1979 |
| JP | 55-2487 | 1/1980 |
| JP | 62-65147 | 4/1987 |
| JP | 63-214131 | 9/1988 |
| JP | 5-45393 | 6/1993 |
| JP | 5-92596 | 12/1993 |
| JP | 6-58491 | 3/1994 |
| JP | 6-129594 | 5/1994 |
| JP | 6-174190 | 6/1994 |
| JP | 6-193795 | 7/1994 |
| JP | 7-110100 | 4/1995 |
| JP | 9-159610 | 6/1997 |
| JP | 9-248735 | 9/1997 |
| JP | 5-99398 | 4/1998 |
| WO | WO 93/01891 | 2/1993 |
| WO | WO 00/09937 | 2/2000 |

*Primary Examiner*—Davis Hwu
(74) *Attorney, Agent, or Firm*—Jordan and Hamburg LLP

(57) ABSTRACT

A liquid spray device, comprising a container (1), a spray injection nozzle (2) for injecting oil spray into the container (1), a spray feeding path (5) for feeding oil spray in the container (1) to the outside of the container (1), oil (11) stored in the container (1), a gas exhaust port provided in the oil (11) by discharging gas into the oil (11), whereby the flow velocity of the oil spray in the spray feeding path can be increased and the amount of oil spray can be increased because an internal pressure of the container can be increased and an oil spray different from the oil spray from the spray injection nozzle can be produced.

19 Claims, 9 Drawing Sheets

U.S. PATENT DOCUMENTS 2,020,325 A 11/1935 Myhren et al.
2,245,601 A 6/1941 Medsker
2,438,868 A 3/1948 Trier
2,613,067 A 10/1952 Goodyear et al.
2,719,604 A 10/1955 Allen
3,240,243 A 3/1966 Golick
3,249,553 A 5/1966 Steinberg
3,439,777 A 4/1969 Gothberg
3,491,855 A 1/1970 Obergefeli et al.
3,618,709 A 11/1971 Boelkins
3,729,898 A * 5/1973 Richardson ..... 55/7
3,744,771 A 7/1973 Deaton
3,756,348 A 9/1973 Iizumi
3,939,944 A 2/1976 Mitchell
3,941,355 A * 3/1976 Simpson ..... 259/4
4,054,622 A 10/1977 Lester
4,131,658 A 12/1978 Hirata et al.
4,309,456 A 1/1982 Lock
4,335,804 A 6/1982 Bardin et al.
4,541,966 A 9/1985 Smith
4,637,493 A 1/1987 Ehlert
4,802,555 A 2/1989 Matsunaga
5,427,203 A 6/1995 Anspach, Jr. et al.
5,462,656 A * 10/1995 Staniec ..... 210/150
5,609,798 A 3/1997 Liu et al.
5,806,630 A 9/1998 Bernal
6,086,052 A * 7/2000 Rowe ..... 261/18.1
6,199,465 B1 * 3/2001 Hattori ..... 83/22

* cited by examiner

LIQUID SPRAY DEVICE AND CUTTING METHOD

TECHNICAL FIELD

The present invention relates to a liquid spray device for feeding spray (liquid particulates) in a container to spray liquid to a target object and a cutting method using the same. More particularly, the present invention relates to a liquid spray device for supplying a cutting member of a machine tool, for example, a machining center, a grinding machine, a turning machine, or the like, with a cutting oil and to a cutting method using the same.

BACKGROUND ART

Hitherto, during machining, oil is sprayed to a target object, for example, a work piece or a tool, etc., in order to enhance the machining accuracy or to extend the life of tools. In a method of directly spraying liquid oil to the target object, the amount to be sprayed becomes too large, so that it takes a long time to remove excess oil, thus reducing the productivity. Furthermore, since the excess oil scatters around the device, it has been necessary to prevent the working environment from being contaminated.

When oil is sprayed in the form of oil droplets, since a machining operation can be performed with only the necessary minimum amount of oil, it is possible not only to improve the process accuracy or productivity, but also to improve the working environment, thus simplifying plant and equipment. JP5-92596U proposes one example of a device capable of spraying oil in the form of oil droplets.

However, in the above-mentioned oil supplying device, it is necessary to provide a spray producing part with a casing for an oil dropping part, a path for fast-speed gas, a Venturi nozzle, and the like. Furthermore, a pump and an oil vessel are formed separately from the main body, thus making the structure of the spray device complicated.

Furthermore, in the above-mentioned oil supplying device, an internal pressure of the main body is dependent upon a primary supply pressure and a hole diameter (a cross-sectional area) of a tip spray injection part. Consequently, as the hole diameter of the spray injecting part is changed, the internal pressure of the main body changes accordingly. Therefore, when, for example, a tool provided with a discharging port is used as the spray injection part, if the tool is replaced with one having a smaller hole diameter, the internal pressure of the main body is increased. In this case, the flow velocity of spray injection can be secured without any problems. However, since the difference between the primary supply pressure and the internal pressure of the main body is reduced, a sufficient amount of spray may not be produced effectively at a spray production part.

On the contrary, if the tool is replaced with one having a larger hole diameter, the internal pressure of the main body is reduced. In this case, it is possible to secure the difference between the primary supply pressure and the internal pressure of the main body. Therefore, there is no problem in producing spray effectively. However, occasionally, the flow velocity of injection cannot be secured sufficiently. Actually, a number of production plants employ unmanned operation. Therefore, it is impossible to adjust the supply pressure every time the hole diameter of injection is changed.

DISCLOSURE OF INVENTION

It is an object of the present invention to provide a liquid spray device capable of reliably producing a fine spray stably with a simple structure and of securing a flow velocity of injecting spray and a cutting method using the same.

In order to attain the above-mentioned object, a first liquid spray device according to the present invention includes a container, a spray injection nozzle for injecting oil spray into the container, a spray feeding path for feeding oil spray in the container to the outside of the container, wherein liquid is stored in the container, and an under-liquid nozzle having a gas exhaust port in the liquid and producing spray by supplying gas into the liquid is provided.

With such a liquid spray device, the use of the under-liquid nozzle can enhance the internal pressure of the container and produce spray in addition to the spray produced by the spray injection nozzle. Thus, it is possible to increase the flow velocity of spray at the exit of the spray feeding path and to increase the amount of spray.

It is preferable in the first liquid spray device that most of the injected spray flow from the spray injection nozzle is allowed to strike the wall face of the container before being fed to the spray feeding path. With such a preferred liquid spray device, since oil spray having a large diameter or oil droplet is easily attached to the wall face, it is possible to prevent the oil spray having a large diameter or oil droplet from entering the spray feeding pipe.

Furthermore, it is preferable that the wall face is a liquid surface of the liquid. With such a liquid spray device, since oil spray having a large diameter or oil droplet is easily absorbed by the liquid surface when striking the liquid surface, it is possible to prevent the oil spray having a large diameter or oil droplet from entering the spray feeding pipe.

Furthermore, it is preferable that the liquid spray device further includes a pressure controlling means for keeping the pressure in the container constant in a path for supplying the gas to the under-liquid nozzle. When the internal pressure of the container is constant, the difference between the primary pressure of the gas supplied to the container and the internal pressure of the container becomes constant, the flow velocity of the gas in the container for spraying is also constant, and thus stable production of spray can be realized. Furthermore, also at the discharging part, since the constant flow velocity can be secured, it is possible to discharge oil spray by converting the oil spray into the oil droplets.

Furthermore, it is preferable that the liquid spray device further includes a gas discharge nozzle having a tip in the air inside the container and discharging gas. With such a liquid spray device, since the internal pressure of the container can be increased, it is possible to increase the flow velocity at the exit part of the spray feeding path.

Furthermore, it is preferable that the liquid spray device further includes a pressure controlling means for keeping the pressure in the container constant for feeding gas into a path for supplying the gas to the gas discharge nozzle. If the internal pressure for feeding gas into the container is constant, the difference between the primary pressure in the container and the internal pressure of the container becomes constant. As a result, the flow velocity of the gas for producing spray in the container is also constant, thus realizing the stable production of spray. Furthermore, it is possible to obtain the constant flow velocity also at the discharge part, and it is possible to discharge spray in the form of oil droplets.

Furthermore, it is preferable that a tip-tapered discharge part is connected to the tip of the spray feeding path. With such a liquid spray device, the flow velocity of spray at the discharge part is increased, and it is possible to take out the spray in the form of oil droplets.

Furthermore, it is preferable that gas and liquid are fed to the spray injection nozzle, and the spray is injected into the container by mixing the gas and the liquid in the spray injection nozzle.

Furthermore it is preferable that the liquid stored in the container flows into a liquid supply means and the liquid discharged from the liquid supply means is fed to the spray injection nozzle. With such a liquid spray device, it is not necessary to provide an oil tank separately, so that it is possible to circulate the liquid in the container effectively.

Furthermore, it is preferable that the liquid supply means is a liquid pump.

Furthermore, it is preferable that the liquid supply means is a siphon tube having the tip portion in the liquid stored in the container and capable of siphoning up the liquid stored in the container.

Furthermore, it is preferable that the liquid spray device further includes a pressure control means for keeping the pressure in the container constant in a path for supplying the gas to the spray injection nozzle. When the internal pressure of the container is constant, the difference between the primary pressure of the gas supplied to the container and the internal pressure of the container is constant, the flow velocity of the gas in the container for spraying is also constant, and thus stable production of spray can be realized. Furthermore, also at the discharge part, the constant flow velocity can be secured, and it is possible to discharge oil spray by converting oil spray into oil droplets.

Next, according to a second liquid spray device of the present invention, the liquid spray device includes a container, a spray injection nozzle for injecting spray into the container, and a spray feeding path for feeding the spray in the container to the outside of the container, wherein most of the injected spray flow from the spray injection nozzle is allowed to strike the wall face in the container before being fed to the spray feeding path.

According to such a liquid spray device, since oil spray having a large diameter or oil droplets are attached easily to the wall face when they strike the wall face, it is possible to prevent the oil spray having a large diameter or oil droplets from entering the spray feeding pipe.

It is preferable in the second liquid spray device that the inside of the container is divided into an upper space and a lower space by the wall face, and the injection port of the spray injection nozzle is located in the lower space.

According to such a liquid spray device, since oil spray having a large diameter or oil droplets are attached easily to the wall face when they strike the wall face, and most of the attached spray and droplets drop to the lower part of the container by gravity. Therefore, most of the spray or droplets fed to the upper space is fine spray. Thus, it is possible to prevent oil spray having a large diameter or oil droplet from entering the spray feeding pipe.

Furthermore, it is preferable that the inside of the container is divided into an upper space and a lower space by the wall face, and the injection port of the spray injection nozzle is located in the upper space.

According to such a liquid spray device, since most of oil spray having a large diameter or oil droplet is attached to the wall face, when it strikes the wall face, most of the attached spray and droplets drop to the lower part of the container by gravity along the wall face. Therefore, most of the spray or droplets fed to the upper space is fine spray. Thus, it is possible to prevent oil spray having a large diameter or oil droplet from entering the spray feeding pipe.

Furthermore, it is preferable that the wall face is the inner wall face of a dome member opening downward. With such a liquid spray device, it is easy to drop spray having a large diameter or droplets to the lower space, that is, a lower part of the container.

Furthermore, it is preferable that the wall face is the outer wall face of a dome member opening downward. With such a liquid spray device, it is easy to drop spray having a large diameter or droplets to the lower space, that is, a lower part of the container.

Furthermore, it is preferable that the wall face is a liquid surface of the liquid stored in the container. With such a liquid spray device, since oil spray having a large diameter or droplets are easily attached to the wall face when they strike the face, it is possible to prevent the oil spray having a large diameter or droplets from entering the spray feeding pipe.

Furthermore, it is preferable that an injected spray flow feeding path is formed on the wall face, and most of the injected spray flow from the spray injection nozzle can be taken out directly to the outside of the container by opening a valve connecting to the injected spray flow feeding path.

With such a liquid spray device, in a case where the screening of the particle size of spray is not required, the injected spray flow from the spray injection nozzle can be taken out to the outside of the container directly.

Furthermore, it is preferable that the injected spray flow, after striking the wall face and before being fed to the spray feeding path, strikes another wall face formed separately from the wall face. With such a liquid spray device, it is possible to prevent the oil spray having a large diameter or oil droplets from entering the spray feeding pipe thoroughly.

Furthermore, it is preferable that the liquid spray device further includes a gas discharge nozzle having a tip in the air inside the container and discharging gas. With such a liquid spray device, since the internal pressure of the container can be increased, it is possible to increase the flow velocity of the spray at the exit part of the spray feeding path.

Furthermore, it is preferable that the liquid spray device further includes a pressure control means for keeping the pressure in the container constant in the path for supplying the gas to the gas discharge nozzle. When the internal pressure of the container for spraying is constant, the difference between the primary pressure of the gas supplied to the container and the internal pressure of the container is constant, the flow velocity of the gas in the container for producing spray is also constant, and thus spray can be produced stably. Furthermore, also at the discharging part, the constant flow velocity can be secured, and it is possible to discharge oil by converting oil spray into the oil droplets.

Furthermore, it is preferable that a tip-tapered discharge part is connected to the tip of the spray feeding path. With such a liquid spray device, the flow velocity is increased at the injection part, so that it is possible to take out oil by converting oil spray into droplets.

Furthermore, it is preferable that gas and liquid are fed to the spray injection nozzle, and the spray is injected into the container by mixing the gas and the liquid in the spray injection nozzle.

Furthermore, it is preferable that the liquid stored in the container flows into a liquid supply means and the liquid supplied from the liquid supply means is fed to the spray injection nozzle. With such a liquid spray device, an oil tank is not provided separately, thus circulating the liquid in the container efficiently.

Furthermore, it is preferable that the liquid supply means is a liquid pump.

Furthermore, it is preferable that the liquid supply means is a siphon tube having a tip portion in the liquid stored in the container and capable of siphoning up the liquid stored in the container.

Furthermore, it is preferable that the liquid spray device further includes a pressure control means for keeping the pressure in the container constant in a path for supplying the gas to the spray injection nozzle. When the internal pressure of the container is constant, the difference between the primary pressure of the gas supplied to the container and the internal pressure of the container is constant, the flow velocity of the gas in the container for producing spray is also constant, and thus spray can be produced stably. Furthermore, also at the discharging part, the constant flow velocity can be secured, and it is possible to discharge oil by converting oil spray into the oil droplets.

Next, according to a third liquid spray device of the present invention, spray in a container passes through the spray feeding path and is fed to the outside of the container by pressure of the gas supplied into the container, and a pressure control means keeps the pressure in the container constant.

With such a liquid spray device, spray having a large diameter can be trapped in the container constantly. The feeding of spray has an excellent fast-response property. It is possible to keep the internal pressure of the container constant. Therefore, the difference between the primary pressure of the gas supplying to the gas and the internal pressure of the container is constant and the flow velocity of gas for producing spray is also constant, and thus spray can be produced stably. Furthermore, since it is possible to obtain the constant flow velocity at the injection part, it is possible to inject the spray in the form of oil droplets and to prevent the flow velocity of the spray from changing. As a result, the amount of discharge spray can be made stable.

It is preferable in the above-mentioned third liquid spray device of the present invention that the spray is injected from the spray injection nozzle for injecting the spray into the container, gas and liquid are fed to the spray injection nozzle, and the spray is injected into the container by mixing the gas and the liquid in the spray injection nozzle.

Furthermore, it is preferable that the liquid spray device includes the pressure control means in the path for supplying the gas to the spray injection nozzle.

Furthermore, it is preferable that liquid is stored in the container, and an under-liquid nozzle having a gas exhaust port in the liquid and producing the spray from liquid by supplying gas to the liquid by the under-liquid nozzle is provided.

Furthermore, it is preferable that the liquid spray device further includes a pressure control means in a path for supplying the gas to the under-liquid nozzle.

Furthermore, it is preferable that the pressure control means has a pressure regulating valve connecting to the gas supplying path, closes the pressure regulating valve to stop supplying the gas when the pressure in the container is increased and reaches a set value, and opens the pressure regulating valve to resume gas supply when the pressure in the container drops to the predetermined pressure. With such a liquid spray device, since the structure is simple, the cost can be minimized, and the attachment work is simplified.

Furthermore, it is preferable that the set value can be changed. Such a liquid spray device can be used in different manners depending upon the applications of use.

Furthermore, it is preferable that the pressure control means has an electromagnetic valve connecting to the gas supplying path and a pressure switch having a pressure detection part located in the container, wherein when the pressure in the container is increased and reaches the upper limit of the set value, the pressure switch closes the electromagnetic valve to stop supplying gas, and when the pressure in the container drops to the lower limit of the set value, the pressure switch opens the electromagnetic valve to re-start to supply the gas. With such a liquid spray device, the operation becomes more reliable, and the accuracy in the pressure control can be enhanced.

Furthermore, it is preferable that the pressure switch has a plurality of combinations of different upper limit set values and lower limit set values and can be switched between the combinations. With such a pressure switch, the device can be used separately for several purposes, for example, for cutting and for air blowing.

Furthermore, it is preferable that the pressure control means has a valve provided in the gas supplying path and a pressure sensor for detecting the pressure of the gas after passing through the valve, and a control part, wherein the detection pressure detected by the pressure sensor is converted into electric signals and the electric signals are processed arithmetically at the control part, and the control part produces a signal to close the valve so as to stop supplying the gas when it judges that the detection pressure reaches the upper limit of the set value, and the control part produces a signal to open the valve so as to resume gas supply when it judges that the detection pressure reaches the lower limit of the set value. With such a liquid spray device, the operation is more reliable, and the accuracy in the pressure control can be enhanced.

Furthermore, it is preferable that the pressure sensor is located in the container.

Furthermore, it is preferable that the pressure sensor is located between the valve and the container in the gas supplying path.

Furthermore, it is preferable that the pressure sensor is located in the spray feeding path.

Furthermore, it is preferable that the upper limit and lower limit set values can be changed. With such a liquid spray device, the device can be used separately for several purposes, for example, for cutting and for air blowing.

Furthermore, it is preferable that a tip-tapered discharging part is connected to the tip of the spray feeding path. With such a liquid spray device, since the flow velocity of spray is increased at the spray discharge part, spray can be taken out in the form of droplets.

Next, according to a first cutting method of the present invention, a cutting method includes attaching a liquid spray device to an oil supplying part of a machine tool, the liquid spray device including a container, a spray injection nozzle for injecting oil spray into the container, a spray feeding path for feeding oil spray in the container to the outside of the container, wherein the oil is stored in the container, and an under-liquid nozzle having a gas exhaust port produces spray by discharging gas into the oil; and cutting the target object to be processed by supplying the spray to a cutting member of the machine tool.

According to the above-mentioned cutting method, since the spray is supplied to the target object to be processed, the spraying amount can be minimized, thus improving the productivity and preventing the operation environment from being contaminated. Furthermore, since the liquid spray device is provided with the under-liquid nozzle, the internal pressure in the container can be increased, and another spray can be produced in addition to the spray from the spray injection nozzle. Therefore, the flow velocity of the spray at the exit part of the spray feeding path can be increased and the amount of spray can be increased.

It is preferable in the above-mentioned first cutting method that most of the injected spray flow from the spray injection nozzle is allowed to strike the wall face of the container before being fed to the spray injection path. According to the above-mentioned cutting method, since spray having a large diameter or droplets are attached easily to the wall face, it is possible to prevent the oil spray having a large diameter or droplets from entering the spray feeding pipe.

Next, according to a second cutting method, a cutting method includes attaching a liquid spray device to an oil supplying part of a machine tool, the liquid spray device including a container, a spray injection nozzle for injecting oil spray into the container, a spray feeding path for feeding oil spray in the container to the outside of the container, wherein most of the spray from the injection nozzle is allowed to strike a wall face in the container before being fed to the spray feeding path; and cutting the target object to be processed by supplying the spray to a cutting member of the machine tool.

According to the above-mentioned cutting method, since the spray is supplied to the target object to be processed, the spraying amount can be minimized, thus improving the productivity and preventing the operation environment from being contaminated. Since spray having a large diameter or droplets are attached easily to the wall face, it is possible to prevent the oil spray having a large diameter or droplets from entering the spray feeding pipe.

It is preferable in the pressure control means has an electromagnetic valve connecting to the gas supplying path and a pressure switch having a pressure detection part located in the container, wherein when the pressure in the container is increased and reaches the upper limit of the set value, the pressure switch closes the electromagnetic valve to stop supplying gas, and when the pressure in the container drops to the lower limit of the set value, the pressure switch opens the electromagnetic valve to resume gas supply. In the second cutting method, the inside of the container is divided into an upper space and a lower space by the wall face, in which the injection port of the spray injection nozzle is located in the lower space. According to the above-mentioned cutting method spray having a large diameter or droplets are attached easily to the wall face. Most of the attached spray or droplets drop by gravity into the lower space, that is, the lower part of the container, so that most of the spray fed to the upper space is fine spray. Thus, it is possible to prevent the spray having a large diameter or droplets from being fed to the spray feeding pipe.

Furthermore, it is preferable that the container is divided into an upper space and a lower space by the wall face, in which the injection port of the spray injection nozzle is located in the upper space.

According to the above-mentioned cutting method, the spray having a large diameter or droplets, when they strike the wall face, are attached to the wall face, or drop along the wall face downward to the lower space. Therefore, most of the spray fed to the upper space of the container is fine spray. It is possible to prevent the spray having a large diameter or droplets from being fed to the spray feeding pipe.

Next, according to a third cutting method of the present invention, a cutting method includes attaching a spray device to an oil supplying part of the machining tool, wherein in the spray device, the spray in the container passes through the spray feeding path and is fed to the outside of the container by a gas pressure of the gas supplied into the container, and a pressure control means for keeping the pressure inside the container constant is provided; and cutting the target object to be processed by supplying a cutting member of the machining tool with the spray.

According to the above-mentioned cutting method, since the spray is supplied to the target object to be processed, the spraying amount can be minimized, thus improving the productivity and preventing the operation environment from being contaminated. With the above-mentioned liquid spray device, spray having a large diameter can be trapped in the container. The feeding of the spray has an excellent fast-response property. It is possible to keep the internal pressure of the container constant. Therefore, the difference between the primary pressure of the gas supplying to the container and the internal pressure of the container is constant and the flow velocity of gas for producing spray is constant, thus realizing the stable production of spray. Furthermore, it is possible to obtain the constant flow velocity at the discharge part, it is possible to inject the spray in the form of the oil droplets and to prevent the flow velocity of the spray from changing. As a result, the amount of discharge spray can be made stable.

It is preferable in the third cutting method that the pressure control means has a pressure regulating valve connecting to the gas supplying path, and wherein the pressure regulating valve is closed so as to stop supplying the gas when the pressure in the container is increased to the set value, and the pressure regulating valve is opened so as to resume gas supply when the pressure in the container drops to the predetermined pressure.

According to the above-mentioned cutting method, the structure of the liquid spray device is simplified, and it is possible to minimize the cost. The attachment operation is easy.

Furthermore, it is preferable that the pressure control means has an electromagnetic valve connecting to the gas supply path and a pressure switch having a pressure detection part located in the container, and wherein the pressure switch closes the electromagnetic valve to stop supplying the gas when the pressure in the container is increased to the set value, and the pressure switch opens the electromagnetic valve to resume gas supply when the pressure in the container drops to the predetermined pressure. As mentioned above, the operation of the liquid spray device can be made reliable, thus enhancing the accuracy of the pressure control.

Furthermore, it is preferable that the pressure control means includes a valve provided in the gas supplying path, a pressure sensor for detecting the pressure of the gas after passing through the valve and a control part, wherein the detection pressure detected by the pressure sensor is converted into electric signals and the electric signals are processed arithmetically at the control part, wherein the control part sends a signal to close the valve so as to stop the gas supply when it judges that the detection pressure reaches the upper limit of the set value, and the control part sends a signal to open the valve so as to resume gas supply when it judges that the detection pressure reaches the lower limit set value. According to the above-mentioned cutting method, it is possible to obtain more reliable operation and to enhance the accuracy in the pressure control.

BRIEF DESCRIPTION OF DRAWINGS

FIG. 8(*b*) shows a pressure control circuit in Embodiment 9 according to the present invention.

FIG. 8(*c*) shows a pressure control circuit in Embodiment 10 according to the present invention.

BEST MODE OF CARRYING OUT THE INVENTION

Hereinafter, the present invention will be described by way of embodiments with reference to drawings. In each embodiment, the liquid spray device according to the present invention is used as an oil supply device.

Embodiment 1

Figure 1:
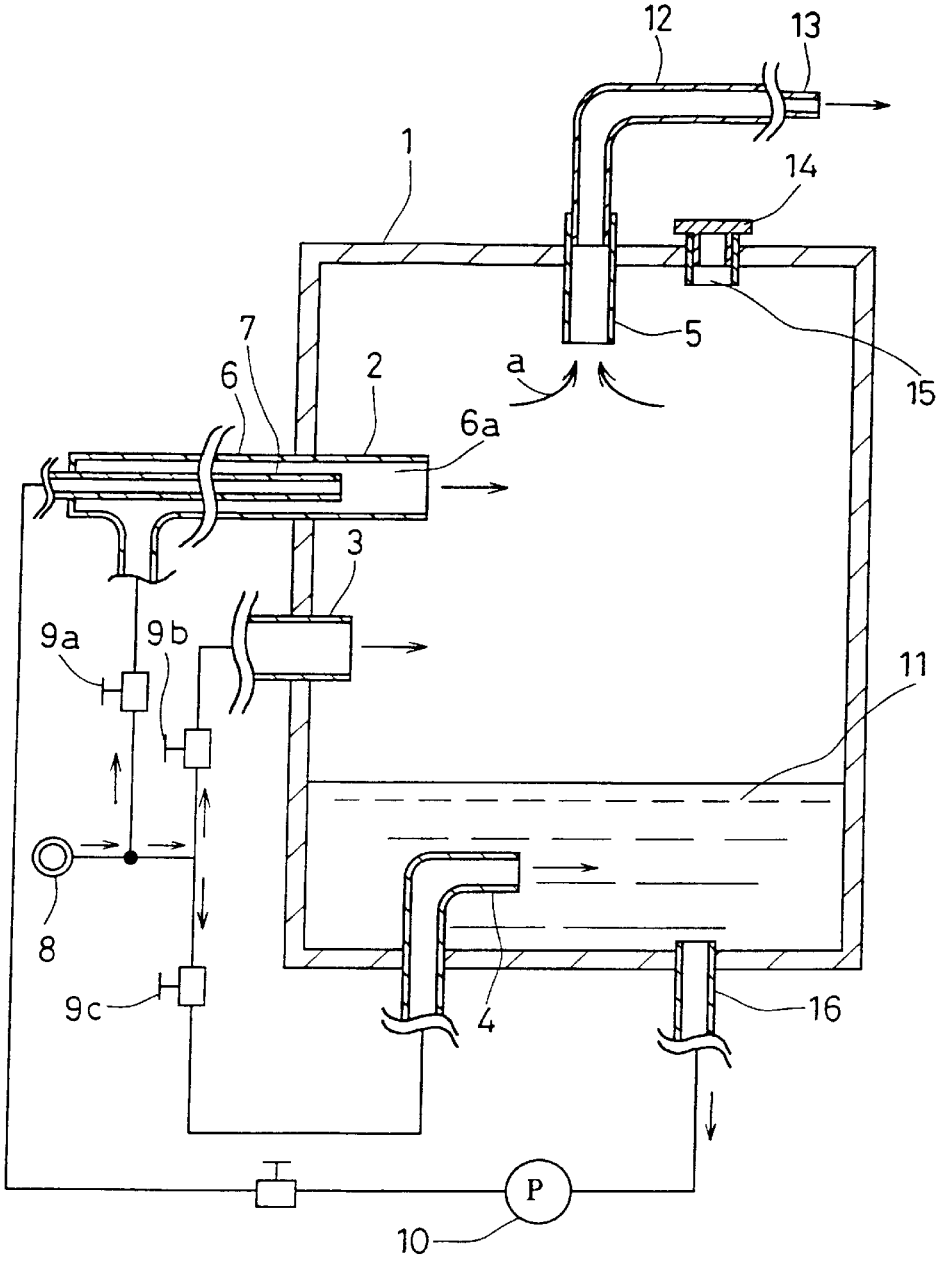
FIG. 1 is a vertical cross sectional view showing a liquid spray device in Embodiment 1 according to the present invention.

FIG. 1 is a vertical cross sectional view showing a liquid spray device according to Embodiment 1. Reference numeral 1 denotes a container. The container 1 is provided with a spray injection nozzle 2, a gas injection nozzle 3, an under-liquid nozzle 4 and a spray feeding pipe 5.

The spray injection nozzle 2 has a dual structure formed of a gas tube 6 and an oil tube 7. The oil tube 7 passes through the gas tube 6. The gas tube 6 is connected to a gas source 8 and the flow rate of injecting gas can be regulated by a gas flow rate regulating valve 9*a*. The oil tube 7 is connected to the oil pump 10. For the gas discharged from the gas source 8, for example, air is used.

Furthermore, at the tip of the spray injection nozzle 2 inside the container 1, the tip of the oil tube 7 enters the inside of the gas tube 6. At the nozzle tip 6*a*, oil supplied from the oil pump 10 and gas supplied from the gas source 8 are mixed with each other, and thus oil spray is produced and injected into the container 1.

The gas injection nozzle 3 supplies the container 1 with gas and is connected to the gas source 8 and the flow rate of injecting gas can be regulated by a gas flow rate regulating valve 9*b*.

The under-liquid nozzle 4 is immersed in oil 11 filled in the container 1 in a predetermined amount. The under-liquid nozzle 4 is connected to the gas source 8 and the flow rate of injecting gas can be regulated by a gas flow rate regulating valve 9*c*. When the gas is injected into the oil 11 from the under-liquid nozzle 4, the oil 11 is entrained by the injected gas and splashed and entrained from the liquid surface of the oil as an oil spray.

The spray feeding pipe 5 feeds the spray in the container 1 to the outside of the container 1. The spray feeding pipe 5 is connected to a spray feeding outside pipe 12 for feeding the oil spray to a target object. The tip side of the spray feeding outside pipe 12 is connected to a tip-tapered discharge part 13.

For example, the spray feeding outside pipe 12 can be used as follows: the spray feeding outside pipe 12 is connected to a spindle with an oil hole of the machining center; and a drill is attached to the spindle having an oil hole as a discharge part 13. The drill has a discharge part having a smaller hole diameter at the tip thereof Furthermore, it is possible to fill the oil 11 inside the container 1 from an oil supply port 15 by removing an oil supply cap 14. The oil 11 flows into the pump 10 through a supply port 16. The following is an explanation of the operation in which the oil spray inside the container 1 flows to the outside of the container. Both oil spray injected from the nozzle tip 6*a* of the spray injection nozzle 2 and oil spray produced from the liquid surface of the oil 11 by the under-liquid nozzle 4 can be supplied into the container 1.

First, the case in which the oil spray is supplied into the container 1 only by the spray injection nozzle 2 by stopping the gas supply from the under-liquid nozzle 4 is explained. The particle size of the oil spray injected from the nozzle tip portion 6*a* ranges from small to large.

Furthermore, oil is injected not only in the form of spray but also in the form of oil droplets. Oil spray having a large particle size or oil droplets easily drops by gravity. On the other hand, fine oil spray drops by gravity relatively slowly and resides in the container for a long time. Fine oil spray herein denotes oil spray that is capable of drifting in the air in the form of fume.

The air pressure from the spray injection nozzle 2 is applied to the inside of the container 1, so that fine oil spray residing in the container 1 is affected by the pressure applied and moves in the direction shown by an arrow a and is fed to the spray feeding pipe 5.

Since the oil spray having a large particle size or oil droplets tends to drop by gravity toward the liquid surface of the oil 11, it is hardly affected by the air pressure. Therefore, such an oil spray having a large particle size or oil droplets does not flow into the spray feeding outside pipe 12 easily.

As mentioned above, since most of the oil spray fed to the spray feeding outside pipe 12 is fine oil spray, it can be fed rapidly and hardly be attached to the inner wall face of the pipe. Therefore, even if the length to the target object becomes long and the pipe length of the feeding pipe is increased, it is possible to allow the oil spray to pass through the feeding pipe in a short time.

The flow velocity of the oil spray is increased after passing through the spray feeding path outside pipe 12 since it passes through the discharge part 13 having a narrower hole diameter. As the flow velocity increases, the particle size of the oil spray is increased. When a certain flow velocity is secured, the oil spray can be formed into the oil droplet.

The oil spray is formed into the oil droplets in this way, because most of the injected oil spray cannot be attached to the target object if the oil spray is injected in the form of fine oil spray or fume Therefore, for example, if the discharge part 13 is a drill that is attached via the spindle with an oil hole of the machining center, the oil droplets are discharged from the tip of the drill. Such oil droplets easily are attached to the target object, thus realizing a smooth process.

Furthermore, since the oil spray flowing into the spindle with an oil hole from the spray feeding pipe 12 has a fine particle size as mentioned above, it is hardly effected by the centrifugal force by the high-speed rotation of the spindle. Thus, it is possible to prevent the oil spray from being attached to the wall face of the oil hole.

Herein, the function of the gas discharge nozzle 3 is explained. As mentioned above, after the oil spray passes through the discharge part 13 having a narrower hole diameter, its flow velocity is increased. The flow velocity is increased as the internal pressure of the container 1 is higher. The internal pressure of the container 1 is also dependent upon the diameter of the discharge port 13. As the hole diameter of the discharge part 13 is smaller, the internal pressure of the container 1 is increased.

Therefore, for example, if the hole diameter of the discharge part 13 is larger than the predetermined diameter, it is not possible to secure the sufficient flow velocity, and thus the particle size of the oil spray is not increased sufficiently, which may lead to the case where the oil spray cannot be converted into the effective oil droplets.

In this case, as in most practical cases, it is impossible to replace a tool used as the discharge part 13 by a tool having an appropriate discharge port. Furthermore, the spray injection nozzle 2 has a small effective cross-sectional area because it is provided for producing spray. Therefore, there is a limitation in order to increase the pressure of the injection gas.

In this case, the gas injection nozzle 3 is used. The gas injected from the gas injection nozzle 3 can enhance the internal pressure of the container 1. Thus, it is possible to secure the flow velocity of the oil spray at the final exit portion. Since the gas injection nozzle 3 aims at only supplying gas, it is possible to increase the effective cross-sectional area as compared with the gas tube 6 of the spray injection nozzle 2, thus to extend the variable range of the pressure of the discharge gas sufficiently.

As mentioned above, even if the device is an oil supply device including only the oil spray from the spray injection nozzle 2, the device can function as an oil supply device.

However, in some cases of, for example, fast-speed and heavy cutting process, etc., a larger amount of oil supply is required.

Furthermore, the pressure of injected gas from the gas injection nozzle 3 increases the internal pressure of the container 1, thus to secure the flow velocity necessary to forming the oil spray into oil droplet at the final exit part. However, in this case, the amount of the oil spray of the container 1 is reduced at the same time. This is caused by the reduction of the gas flow rate for producing oil spray because the gas injection from the gas injection nozzle 3 increase the internal pressure of the container 1, so that the difference between the discharge gas pressure from the gas tube 6 and the internal pressure of the container 1 is reduced.

In such a case, the under-liquid nozzle 4, which is immersed in the oil 11, is responsible for increasing the internal pressure of the container 1 and increasing the amount of the oil spray inside the container 1. As mentioned above, gas injected from the under-liquid nozzle 4 allows the oil spray from the liquid surface of the oil 11 to spray and diffuse.

By injecting gas from the under-liquid nozzle 4, the internal pressure of the container 1 is increased. At the same time, it is possible to produce the oil spray in addition to the oil spray from the spray injection nozzle 2. Consequently, it is possible to compensate the reduction of oil spray from the spray injection nozzle 2 due to the increase of the internal pressure of the container 1.

In the other words, it is possible to minimize the reduction of the amount of the oil spray in the container 1 by supplying the gas from the under-liquid nozzle 4 while securing the flow velocity necessary for forming the oil spray into oil droplets at the final exit part.

In this embodiment, it is possible to increase the internal pressure of the container 1 by supplying the gas from the under-liquid nozzle 4, so that the device can be used while stopping the gas injected from the gas injection nozzle 3. When using the gas injected from the gas injection nozzle 3 together, it is possible to extend the variable range of the internal pressure of the container 1. Therefore, when the necessary internal pressure of the container 1 is secured, the gas device may not be provided with the injection nozzle 3.

Furthermore, in this embodiment, when the injection pressure from the under-liquid nozzle 4 is set to be constant by using a regulator or the like, even if the tool such as a tip drill, etc. is replaced, fine adjustment in accordance with the change in the cross sectional area of the exit part is not required. For example, when the cross sectional area of the exit part becomes narrower, and the internal pressure of the container 1 becomes a constant value or more, gas supplied from the under-liquid nozzle 4 stops, so that unnecessary gas supply can be inhibited. In this case, only the oil spray from the spray injection nozzle 2 can be injected into the container 1.

On the contrary, when the internal pressure of the container 1 is lower than a certain value, the gas is supplied from the under-liquid nozzle 4 in accordance with the difference between the supplying pressure from the under-liquid nozzle 4 and the internal pressure of the container 1, and thus the necessary pressure of the container 1 can be secured.

Furthermore, in this embodiment, it is possible to produce oil spray by the gas supplied from the under-liquid nozzle 4, in addition to the oil spray from the spray injection nozzle 2. Therefore, as compared with the case of injecting the same amount of oil spray only from the spray injection nozzle 2, the work of the oil pump 10 can be reduced.

Furthermore, in order to produce the oil spray from the spray injection nozzle 2, it is necessary to perform a preliminary run until oil is supplied from the oil pump 10 to the tip 6*a* of the nozzle. The same is true in the case where a siphon tube is used for supplying oil. When the oil spray is produced by the gas injected from the under-liquid nozzle 4, oil spray is produced from the liquid surface right after the gas is injected. Thus, the preliminary run is not required.

Furthermore, the amount of filled oil (liquid surface) is above the injection port of the under-liquid nozzle 4, and oil spray is produced surely. Therefore, it is possible to check whether the oil spray is produced or not from the outside of the container by the use of, for example, a float level switch.

Furthermore, it is possible to check the gas discharge pressure of the container 1 by providing a pressure switch. From the discharge pressure, the virtual flow velocity of the oil spray at the exit part can be calculated, and thus the effectiveness of the oil spray state is determined.

In this embodiment, the case where both the oil spray from the spray injection nozzle 2 and gas injected from the under-liquid nozzle 4 are supplied was explained. However, depending upon the application of use, the device without a spray injection nozzle can be employed. In such a device, an oil pump is not necessary, and its maintenance need not be carried out.

Furthermore, the spray feeding outside pipe 12 is not necessarily single but a plurality of branched pipes 12 can be connected. In this case, it is possible to spray liquid to several places by using one device.

Furthermore, there is no limitation to the shape of the container as long as the container is designed by taking the improvement of the merchantability, easiness in manufacture, maintenance property, and the like. The shape is not necessarily limited to the circular but a prismatic shape also can be employed. For example, when the merchantability is important, for example, a box shaped tank may be employed.

Second Embodiment 2

The device of Embodiment 2 is the same as that of Embodiment 1. The device of Embodiment 2 is characterized by the relationship between the tip portion of the spray injection nozzle 2 and the internal wall face of the container 1. With such a device of Embodiment 1, the length between the tip portion of the spray injection nozzle 2 and the tip portion of the spray feeding pipe 5 is set to be sufficiently long so that, it is securely possible to drop the oil spray having a large particle size or oil droplets onto the liquid surface.

The device of Embodiment 2 is effective in a case where the container is relatively small and the sufficient length between the tip portion of the spray injection nozzle 2 and the tip portion of the spray feeding pipe 5 cannot be obtained.

Figure 2:
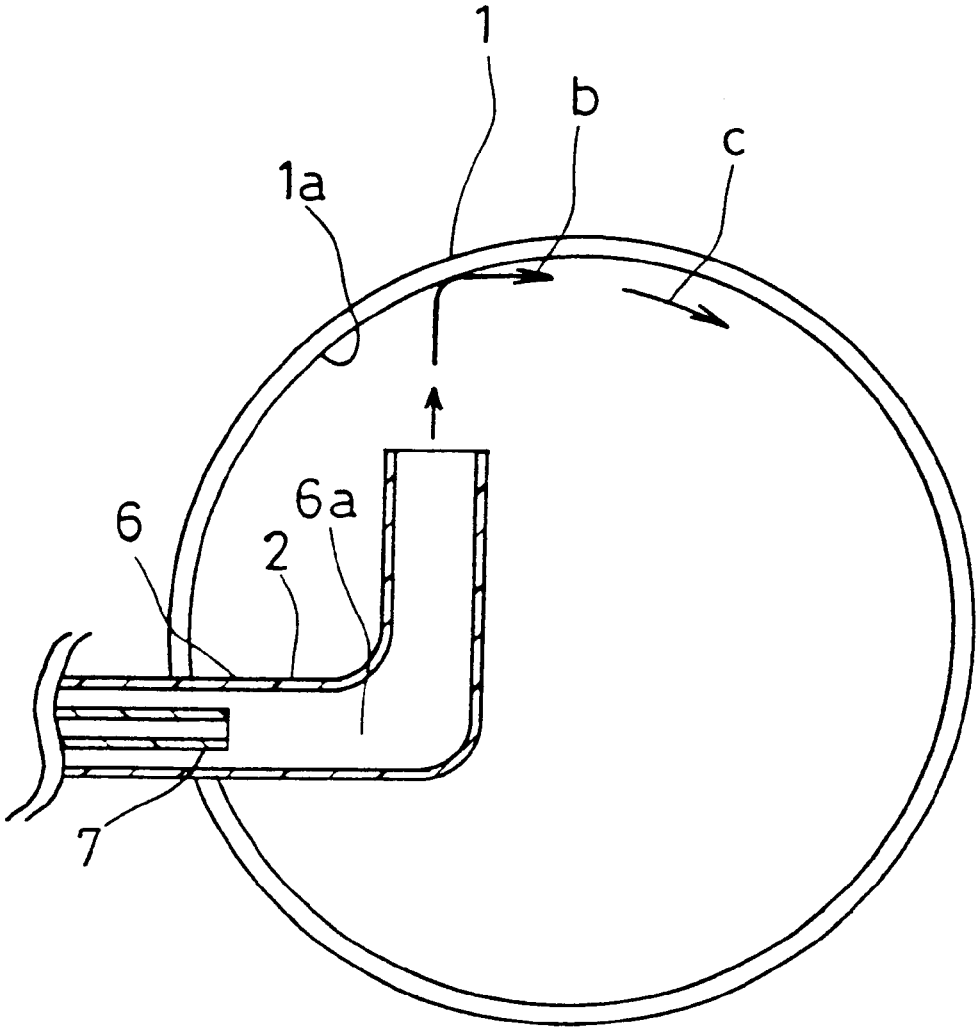
FIG. 2 is a horizontal cross sectional view showing a liquid spray device in Embodiment 2 according to the present invention.

FIG. 2 is a horizontal cross sectional view showing a liquid spray device according to Embodiment 2. The tip portion of the spray injection nozzle 2 is located so that most of injected flow amount strikes the face of the inner wall 1*a* before being fed to the spray feeding pipe 5. In other words, most of injected spray flow amount from the spray injection nozzle 2 strikes the face of the inner wall 1*a* without passing through the center of the container 1 (shown by an arrow b).

Most of the fine oil spray is not attached to the wall face when striking the wall face, while oil spray having a large particle size or oil droplets is attached easily to the wall face. As the particle size of the oil spray increases, it tends to be attached to the wall face. In particular, oil droplets further tend to be attached to the wall face. Furthermore, the oil spray having a large particle size or oil droplet is attached to the inner wall face 1*a* while circulating along the inner wall face 1*a* in the direction shown by an arrow c after striking the inner wall face 1*a*.

Therefore, among the injected spray flow amount from the spray injection nozzle 2, most of the oil spray having a large particle size or oil droplets is attached to the inner wall face 1*a*. Moreover, most amount of the oil spray having a large particle size or oil droplets flowing in the air inside the container 1 without being attached to the face of the inner wall 1*a* drops by gravity. Therefore, it is possible to prevent the oil spray having a large particle size or oil droplets from being fed to the spray feeding pipe 5.

Moreover, the location relationship between the tip portion of the spray injection nozzle 2 and the opposing inner wall face 1*a* is not particularly limited as long as most of the injected spray flow strikes the inner wall face 1*a* directly before being fed to the spray feeding pipe 5. The injected spray flow may strike vertically with respect to the inner wall face 1*a* or may strike obliquely to the inner wall face 1*a*.

Furthermore, the case where the injected spray flow is allowed to strike the inner wall face in the container was explained. A special wall face may be provided, separately.

The device having a basic structure according to Embodiment 1 was explained. The same effect can be obtained with a device without having an under-liquid nozzle or a gas injection nozzle.

Embodiment 3

The device according to Embodiment 3 is the same as that of the Embodiment 1 except for the location relationship between the tip portion of the spray injection nozzle and the liquid surface of oil.

Figure 3:
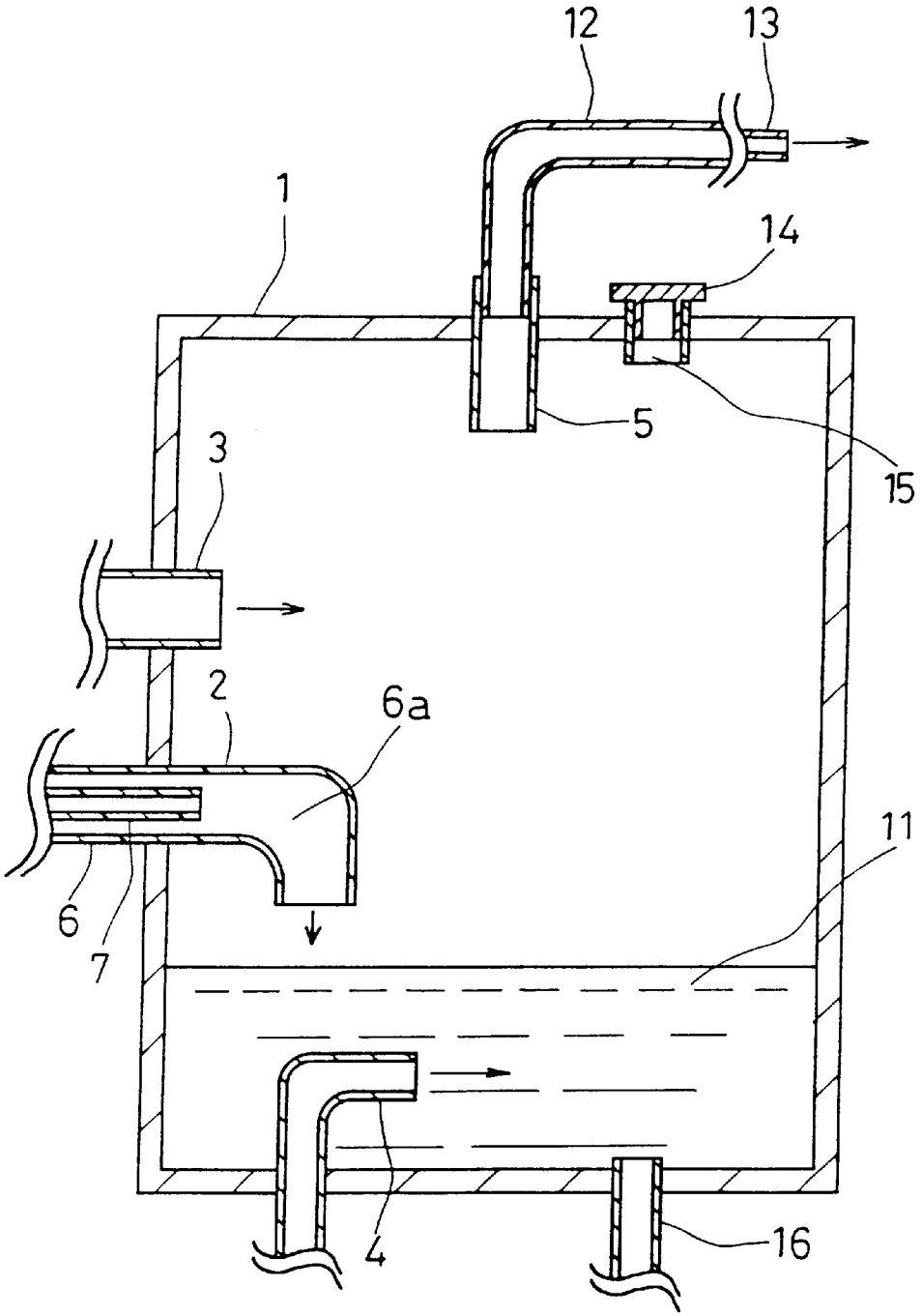
FIG. 3 is a vertical cross sectional view showing a liquid spray device in Embodiment 3 according to the present invention.

FIG. 3 is a vertical cross sectional view showing a liquid spray device according to Embodiment 3. The device of FIG. 3 is the same as that of FIG. 1 except for the locations of the spray injection nozzle 2 and the gas injection nozzle 3. Therefore, the part such as a gas circuit etc., is not shown herein. The tip portion of the spray injection nozzle 2 is directed to the liquid surface side of the oil 11. The length between the tip and the liquid surface is made to be close so that the spouting of the oil 11 from the liquid surface can be prevented. Therefore, most of the injected spray flow from the spray injection nozzle strikes the liquid surface directly before being fed to the spray feeding pipe 5.

Fine oil spray is hardly absorbed into the liquid surface even if it strikes the liquid surface and flows in the container 1. The oil spray having a large particle size or oil droplets is absorbed easily into the face of the liquid surface when it strikes the liquid surface not only due to dropping by gravity but also because the injection direction is toward the liquid surface side. Therefore, upon striking the liquid surface, they likely to be absorbed there. As the particle size of the oil spray is larger, it tends to be absorbed to the liquid surface. In particular, oil droplets further tend to be attached to the oil surface.

Therefore, most of the injected spray flow from the spray injection nozzle 2, oil spray having a large particle size or oil droplets, is absorbed into the oil 11 without being fed to the spray feeding pipe 5. Therefore, it is possible to prevent from the oil spray having a large particle size or oil droplets from being fed to the spray feeding pipe 5.

Similar to Embodiment 2, the device of this embodiment is effective in a case where the container is relatively small and the length between the tip portion of the spray injection nozzle 2 and the tip portion of the spray feeding pipe 5 cannot be obtained.

Moreover, the location relationship between the tip portion of the spray injection nozzle 2 and the opposing liquid surface is not particularly limited as long as most of the injected spray flow from the spray injection nozzle 2 strikes the liquid surface directly before being fed to the spray feeding pipe 5. For example, the injected spray flow may strike vertically with respect to the liquid surface or may strike obliquely with respect to the liquid surface.

The device having a basic structure according to Embodiment 1 was explained. The same effect can be obtained by a device without having an under-liquid nozzle or a gas discharge nozzle.

Embodiment 4

Figure 4:
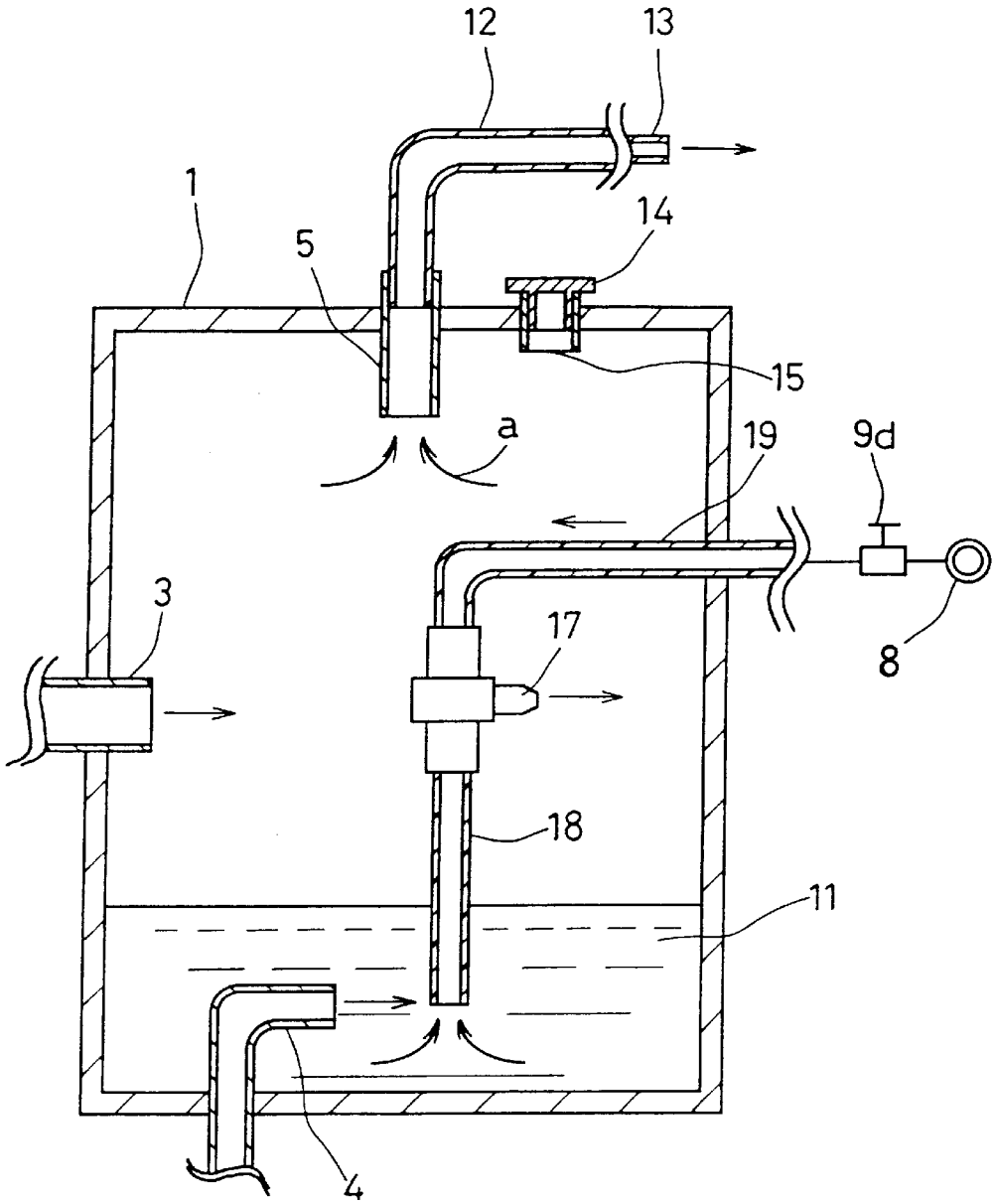
FIG. 4 is a vertical cross sectional view showing a liquid spray device in Embodiment 4 according to the present invention.

Embodiment 1 describes the example in which oil is supplied to the spray injection nozzle by an oil pump. In Embodiment 4, the siphon method is employed instead of using the oil pump. FIG. 4 is a vertical cross sectional view showing a liquid spray device according to Embodiment 4. The device shown in FIG. 4 is the same as that of Embodiment 1 except that the oil supply method employs the siphon method. Therefore, a gas circuit of the gas discharge nozzle 3 and the under-liquid nozzle 4 is not shown herein.

The siphon tube 18 and gas tube 19 are connected to the spray injection nozzle 17. The gas tube 19 is connected to the air source 8 and the flow rate can be regulated by the flow rate regulating valve 9*d*. Inside the spray injection nozzle 17, gas supplied from the gas tube 19 produces the difference between the pressure inside the nozzle and internal pressure of the container.

Therefore, the oil 11 is siphoned up from the lower end of the siphon tube 18 into the spray injection nozzle 17 where the oil and gas supplied form the gas tube 19 are mixed, and thus oil spray is produced and injected into the container 1. In the middle of the siphon tube 18, by providing a throttling valve such as a needle valve, it is possible to regulate the flow rate of oil.

In this embodiment, a gravitational method may be employed instead of the siphon method. In the case of employing the gravitational method, an oil tank is provided separately and oil is supplied to the tube by dropping the oil in the tube by gravity. Also in this case, the oil pump is not necessary.

Embodiment 5

Figure 5:
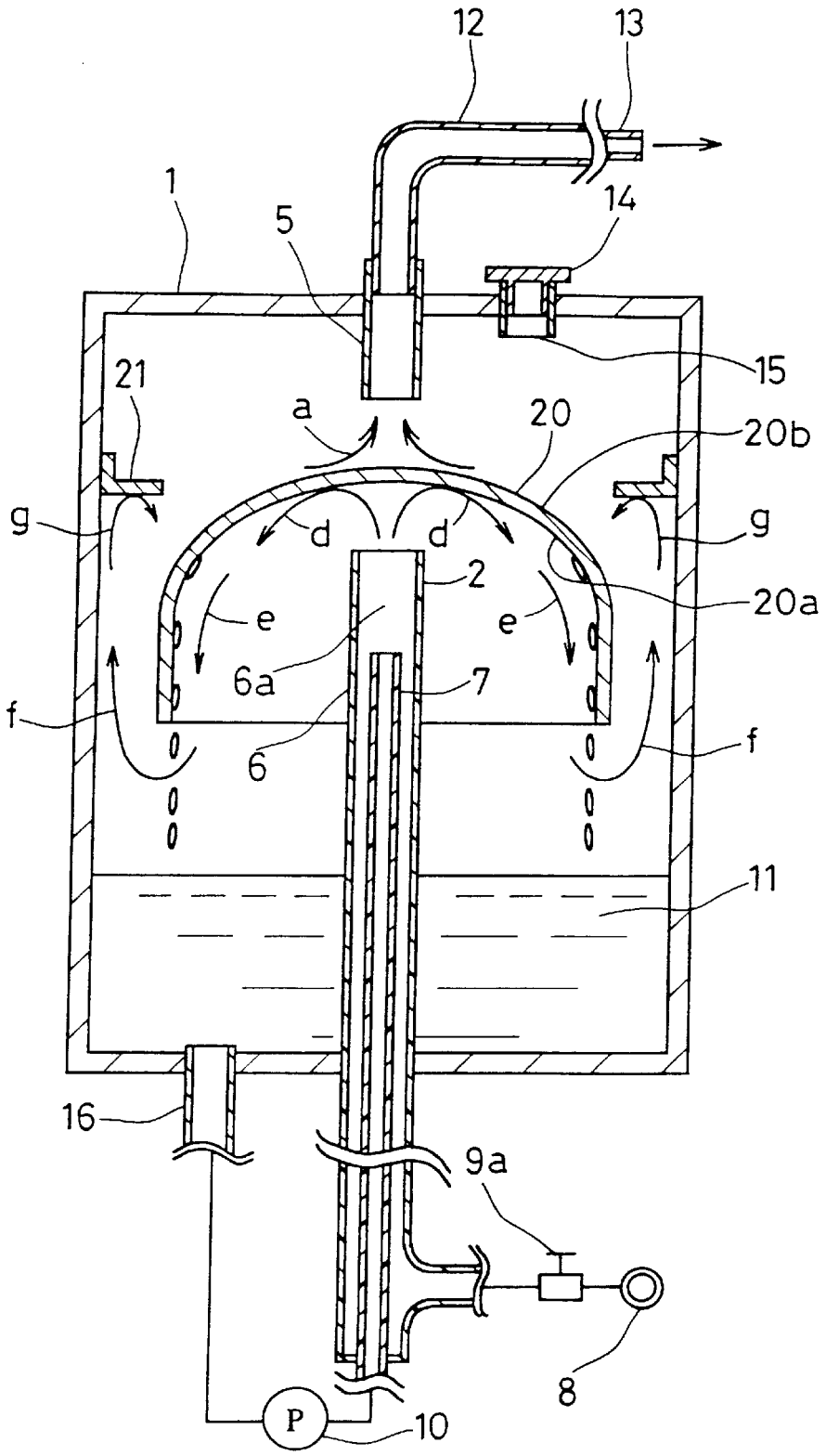
FIG. 5 is a vertical cross sectional view showing a liquid spray device in Embodiment 5 according to the present invention.

FIG. 5 is a vertical cross sectional view showing a liquid spray device according to Embodiment 5. Detailed explanation of the same parts as in FIG. 1 is not repeated herein by giving the same remarks. Inside the container 1, a dome member 20 is provided that opens downward. The spray injection nozzle 2, a tip of which faces the inner wall face 20*a*, is located at the side of the inner wall face 20*a* of the dome member 20.

Similar to Embodiment 1, oil spray is injected into the container 1 from the nozzle tip portion 6*a* of the spray injection nozzle 2. As explained in Embodiment 2, fine oil spray is hardly attached to the wall face even if it strikes the wall face. On the other hand, the oil spray having a large particle size or oil droplets is attached to the wall face easily when striking the wall face.

Therefore, of the injected spray flow from the nozzle tip portion 6*a*, which strikes the inner wall face 20*a*, most of the fine oil spray moves downward along the inner wall face 20*a* without being attached to the inner wall face 20*a* (in the direction shown by arrows d and e) and then moves toward the spray feeding pipe 5 (in the direction shown by an arrows f, g and a).

On the other hand, some of the oil spray having a large particle size or oil droplets strikes the inner wall face 20*a* and is attached to the inner face 20*a*. And some of it is attached to the inner wall face 20*a* while moving along the inner wall face 20*a* in the direction shown by arrows d and e. Furthermore, after they are attached to the inner wall face 20*a*, some of them drop by gravity and some drop toward the oil surface side of the oil 11 by self-weight and flow in the direction shown by the an arrows d and e so as to be pushed down.

Namely, most of the fine oil spray flows toward the upper space of the dome member 20. Most of the oil spray having a large particle size or oil droplets drop toward the lower space, that is, the side of the liquid surface of the oil 11 without flowing to the upper space inside the container. A large quantity of the upflow into the upper space inside the container 1 strikes a flange 21 provided along the inner wall face 20*a*.

Therefore, even if the upflow includes oil spray having a large particle size or oil droplets, it strikes and is attached to the flange 21. In other words, the flange 21 functions as thoroughly preventing the oil spray having a large particle size or oil droplets from feeding into the spray feeding pipe 5.

As mentioned above, since almost all of the oil spray which reaches the upper space is fine oil spray, the tip of the feeding port injection port of the spray feeding pipe 5 is not particularly limited as long as it is located in the upper space of the container. For example, the injection port may be directed downward or side-to-side, or may be an inclined face.

Furthermore, when oil is filled from the oil supply port 15, if oil remains on the outer wall face 20*b* of the dome member, the remaining oil is fed to the spray feeding pipe 5 together with upflow. In one example of dome member 20 shown in FIG. 5, an external wall face 20*b* has an inclined face from the top to the lower side. Furthermore, this inclined face is connected to the vertical face. Therefore, even if the oil is filled from the oil supply port 15, the oil drops along the dome member 20 to the liquid surface. Therefore, it is possible to prevent the filled oil from being fed to the spray feeding pipe 5.

In the above-mentioned explanation, the example is described in which the tip portion 6*a* of the spray injection nozzle 2 is located at the side of the inner wall face 20*a* of the dome member 20. However, the embodiment may be provided in which the nozzle tip portion 6*a* may be located in the upper side of the dome member 20 so that the nozzle tip portion 6*a* faces the external wall face 20*b*. In this case, most of the oil spray having a large particle size or oil droplets is attached to the outer wall face 20*b* when it strikes thereto, or drops toward the side of the liquid surface of the oil 11 along the external wall face 20*b*. Therefore, the oil spray having a large particle size or oil droplets hardly flows upwardly. Thus, most of the oil spray fed to the spray feeding pipe 5 is fine oil spray.

Furthermore, similar to the case where the nozzle tip portion 6*a* is located at the side of the inner wall face 20*a*, by providing the flange 21, it is thoroughly possible to prevent the oil spray having a large particle size or oil droplets from entering the spray feeding pipe 5.

Moreover, the shape of the dome member 20 is not limited to the example shown in FIG. 5, and other shapes may be employed, as long as the dome member opens downward. For example, a hemispherical shape, a conical shape, cylindrical shape or prismatic shape or combination thereof may be employed.

Furthermore, instead of a dome shape, a planar shape may be employed if, for example, the oil supply port 15 is provided in the lower part from the plane member so that filled oil does not reside on the plane.

Embodiment 6

Figure 6:
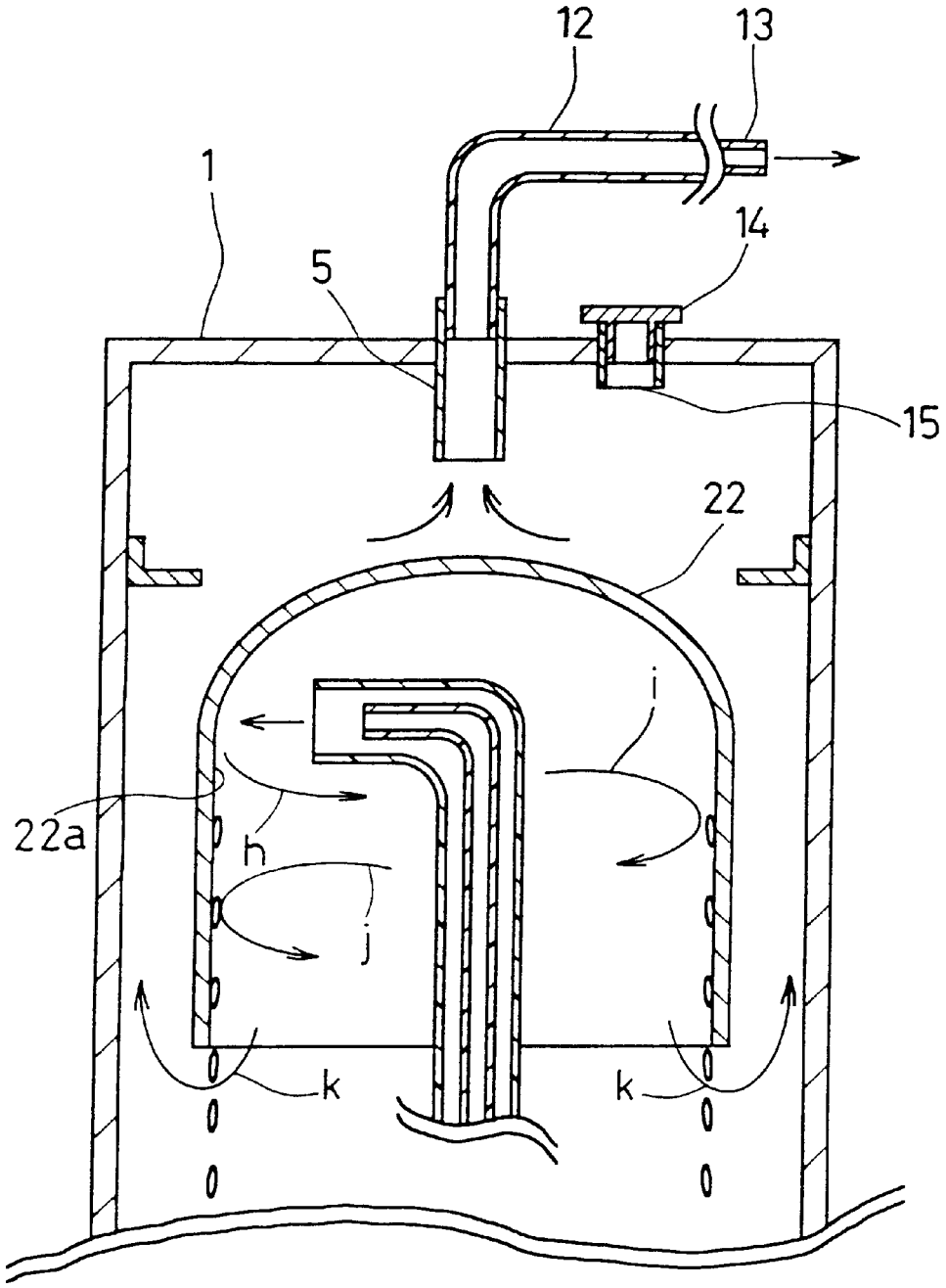
FIG. 6 is a vertical cross sectional view showing a liquid spray device in Embodiment 6 according to the present invention.

FIG. 6 is a vertical cross sectional view showing a liquid spray device according to Embodiment 6. The lower part has the same configuration as that of Embodiment 5 shown in FIG. 5, so the part is not shown herein.

In Embodiment 6, the tip portion of the spray injection nozzle 2 is directed to the side face 22*a* of the dome member 22. Therefore, most of the injected spray flow strikes the side face 22*a* and circulates along the side face 22*a* (in the direction shown by arrows h, i and j). The oil spray having a large particle size or oil droplets is attached not only to the side face 22*a* when striking the side face 22*a* but also attached to the side face 22*a* while circulating along the side face 22*a*. Furthermore, the oil spray attached to the side face 22*a* drops to the liquid surface due to the circulation flow in addition to the self weight.

Therefore, similar to Embodiment 5, most of fine oil spray flows in the upper space of the dome member 22 (in the direction shown by an arrow k). However, most of the oil spray having a large particle size or oil droplets drop toward the side of the liquid surface of the oil 11 without flowing into the upper space of the container.

Embodiment 7

Figure 7:
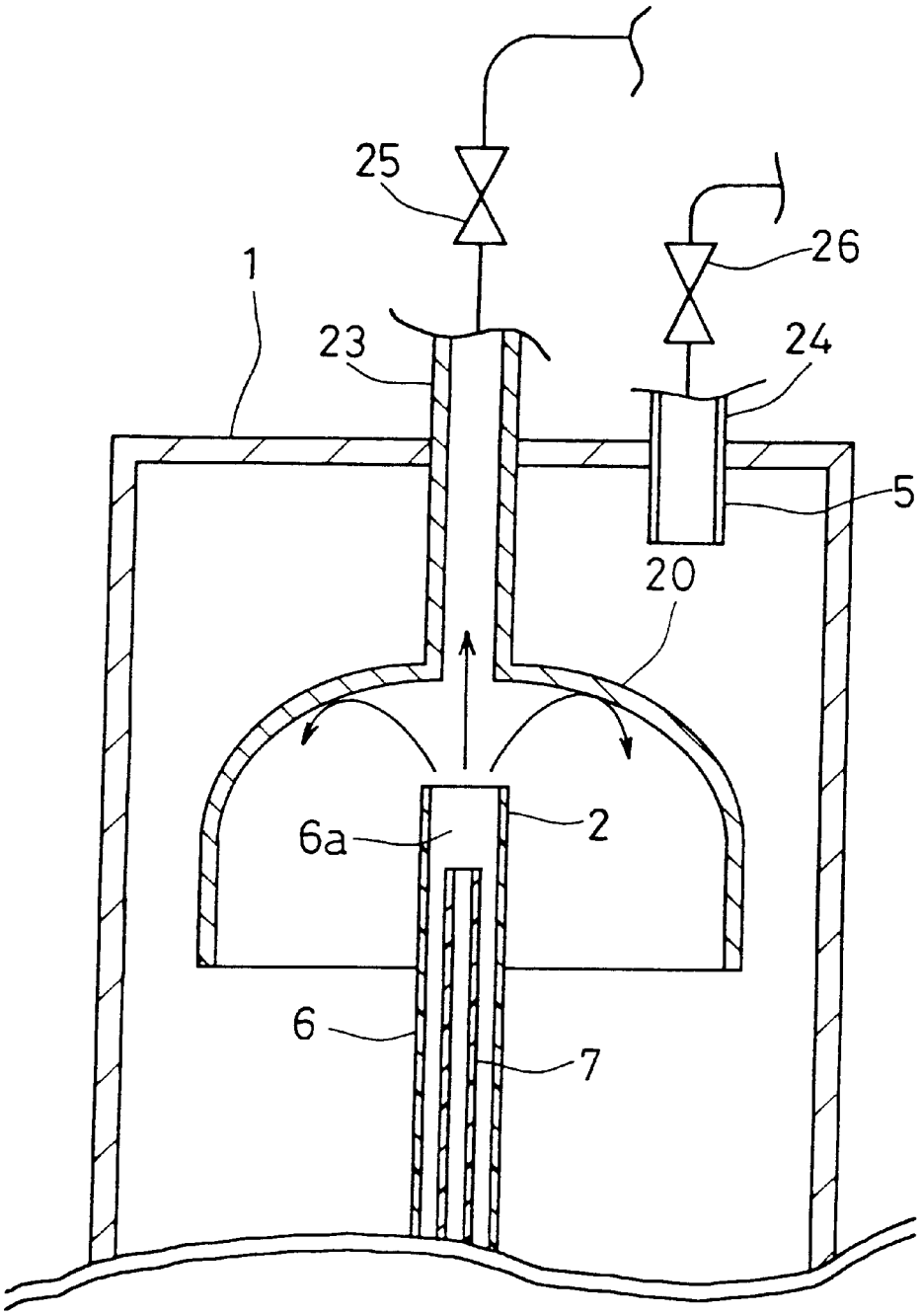
FIG. 7 is a vertical cross sectional view showing a liquid spray device in Embodiment 7 according to the present invention.

FIG. 7 is a vertical cross sectional view showing a liquid spray device according to Embodiment 7. The lower part of this drawing is the same as that shown in FIG. 5 and so is not shown herein. The basic operation of the liquid spray device according to Embodiment 7 is the same as that of Embodiment 5. However, in the liquid spray device of Embodiment 7, the user can select the way of using from the following two ways: that is, the way of taking most of the injected spray flow from the spray injection nozzle 2 out of the container after it strikes the wall face; and the way of taking most of the injected spray flow from the spray injection nozzle 2 directly out of the container.

In the case of taking the injected spray flow from the spray injection nozzle 2 directly to the outside of the container, the oil spray having a large particle size or oil droplets also is taken out together. Thus, such way of using is useful for the case where the classification of the particle size of the oil spray is not required and can be performed by opening and closing a valve 25 connected to a discharge flow feeding pipe 23 and a valve 26 connected to a spray feeding pipe 24.

In the case of taking the injected spray flow from the spray injection nozzle 2 directly to the outside of the container 1, the valve 25 is opened and the valve 26 is closed. Thereby, most of the discharge flow from the spray injection nozzle 2 is fed to the discharge flow feeding pipe 23.

When the discharge flow from the spray injection nozzle 2 is taken out to the outside of the container after classifying the particle size of the discharge flow, the valve 26 is opened and the valve 25 is closed. This operation is the same as that in Embodiment 5, and fine oil spray is fed to the spray feeding pipe 24.

Furthermore, depending upon the application of use, both valves 25 and 26 may be opened. In this case, the discharge flow from the spray injection nozzle 2 directly is fed to the spray feeding pipe 23. Thus, fine oil spray is fed to the spray feeding pipe 24. Therefore, with the liquid spray device of this embodiment, it is possible to use the device in different manners depending upon target objects which oil is supplied.

In the above-mentioned explanation, the nozzle tip portion 6*a* of the spray injection nozzle 2 is located at the side of the inner wall face of the dome member 20 is explained. However, the configuration is not necessarily limited to this. For example, the nozzle tip portion 6*a* is located at the upper side of the dome member 20 and located so that the external wall face of the tip of the nozzle 6*a* faces the external wall face of the dome member. In this case, the discharge flow feeding pipe 23 is located inside the dome member 20. Consequently, the injection spray flow flowing into the injected spray flow feeding pipe 23 from the nozzle tip portion 6*a* is located inside the dome member 20 and moves downward inside the discharge flow feeding pipe 23.

Moreover, in Embodiments 5 to 7, the under-liquid nozzles are not provided. However, the under-liquid nozzle may be provided. Thereby, similar to Embodiments 1 to 4, it is possible to increase the flow velocity of spray at the spray injection path exit part and to increase the amount of spray.

Moreover, in Embodiments 5 to 7, the case where the oil is fed to the spray injection nozzle 2 by the use of oil pump is explained. However, as explained in Embodiment 4, the siphon method or gravitation method may be employed.

Embodiment 8

According to each of the above-mentioned Embodiments, the internal pressure of the container can be regulated, for example in the example shown in FIG. 1, by means of gas flow rate regulating valves 9*a*, 9*b* and 9*c*. Furthermore, as explained in Embodiment 1, in a case where the under-liquid nozzle is used in addition to the spray injection nozzle, even if the cross sectional area of the exit of the discharging port is changed, the internal pressure is regulated automatically. The device of this Embodiment is not designed so that the internal pressure is controlled directly, but the internal pressure of the container consequently is maintained constant.

In the below mentioned Embodiments 8 to 10, regardless of the presence of the under-liquid nozzles, it is possible to keep the internal pressure of the container constant. In other words, by directly controlling the internal pressure of the container by the use of pressure controlling means, the internal pressure of the container automatically is controlled to be constant although the cross sectional area of the exit of the discharging port is changed.

If the internal pressure of the container is constant, the difference between the primary pressure and the internal pressure of the container becomes constant. Therefore, the flow velocity of the gas for producing spray in the container becomes constant. As a result, stable spray production can be performed. Furthermore, also at the discharging port whose cross sectional area of exit is narrow, constant flow velocity can be secured, so that spray is converted into oil droplets and the oil droplets can be injected.

Figure 8:
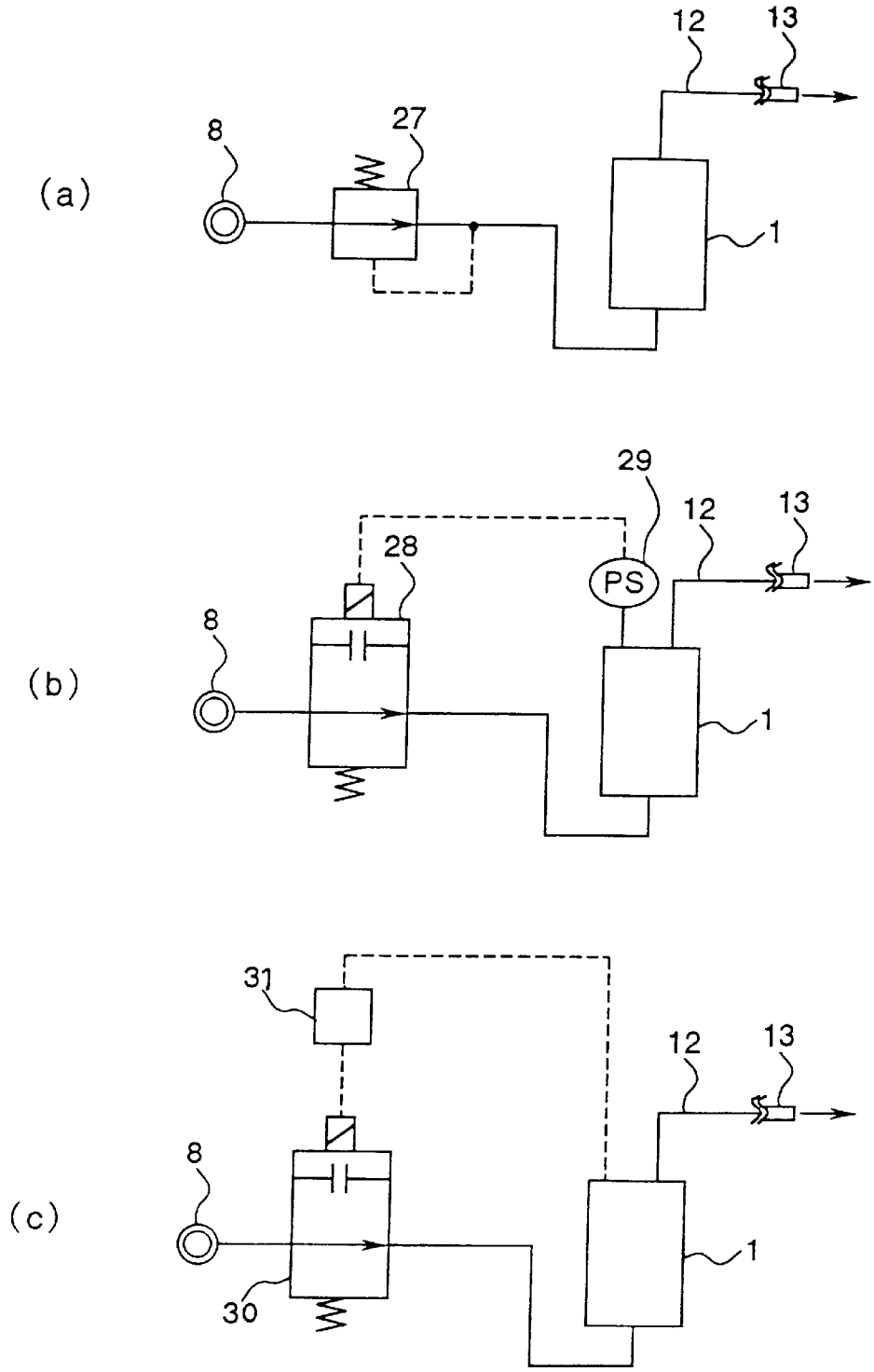
FIG. 8(*a*) shows a pressure control circuit in Embodiment 8 according to the present invention.

FIG. 8 shows a pressure control circuit according to Embodiments 8 to 10. In FIG. 8, an example in which the gas injection nozzle to the container 1 is only the under-liquid nozzle is simplified, but the structure of the container 1 may be any structure of the above-mentioned Embodiments. In other words, the gas supply nozzle to the container 1 may be formed of the spray injection nozzle, the under-liquid nozzle and the gas discharge nozzle, or may be formed of the spray injection nozzle and the under-liquid nozzle, or may be formed only of the gas discharge nozzle.

In Embodiment shown in FIG. 8(*a*), a pressure regulating valve is used as a pressure control means. In this Embodiment, pressure is regulated by mechanical control and it is possible to use a reducing valve capable of opening and closing valve by the compression spring force. The primary supply gas from the gas source 8 is fed to the container 1 via a pressure regulating valve 27. When the cross sectional area of the exit becomes small by replacing the discharging part 13, the internal pressure of the container 1 is increased. If a secondary pressure (pressure of the side of the container 1 with respect to the pressure regulating valve 27) is not less than the set value, gas flowing by a pilot circuit activates the pressure regulating valve 27, thus to stop supplying gas.

When the pressure in the container 1 is reduced to the predetermined value, the pressure regulating valve 27 is opened by the restoring force of spring, and thus the gas is supplied again. Therefore, even if the cross sectional area of the exit of the discharge part 13 is changed, the pressure in the container 1 can be maintained in the constant range by opening and closing the pressure regulating valve 27. According to the mechanical control of this embodiment, since the structure is simple, the cost can be reduced and attachment operation is performed easily.

Furthermore, it is preferable that the pressure regulating valve 27 can regulate the set value by regulating the spring pressure. For example, in order to increase the flow velocity at the injected spray part, the set value is increased. In this case, the difference between the primary pressure and the internal pressure of the container is reduced, so that it is disadvantageous in producing oil spray stably, but the amount of injected spray flow is increased. Therefore, in the cutting process, it is effective in the case where removing cutting powder is more important rather than spraying oil. Furthermore, the device of this embodiment can be used for removing cutting powder by air blowing after the cutting process, if necessary, by regulating the set value.

Embodiment 9

In Embodiment 9, a pressure control circuit shown in FIG. 8(*b*) electrically controls the internal pressure of the container 1. In this embodiment, an electromagnetic valve 28 and a pressure switch 29 are used as a pressure control means. The pressure switch 29 includes a pressure detecting part. The primary supply gas from the gas source 8 is fed to the container via the electromagnetic valve 28.

Secondary pressure (the internal pressure of the container 1) is detected by the pressure switch 29. When the secondary pressure is above the set value (upper limit of the set value), the pressure switch 29 operates, and thereby the electricity is carried to a coil part of the electromagnetic valve 28 (or electricity is stopped carrying), and thus the electromagnetic valve 28 is closed and gas supply is stopped.

When the internal pressure of the container 1 drops to the predetermined value (lower limit of the set value), the pressure switch 29 operates, and thereby the electricity is stopped being carried to a coil portion of the electromagnetic valve 28 (or electricity is carried), and thus the electromagnetic valve 28 is opened and gas supply is resumed. Therefore, the internal pressure of the container automatically is controlled to be within the constant range by opening and closing the electromagnetic valve 28 although the cross sectional area of the exit of the discharge part 13 is changed. According to the electric control of this embodiment, as compared with the mechanical control, operation is more accurate and accuracy of pressure control can be improved although the cost is high.

Furthermore, it is preferable that the pressure switch 29 has several combinations, in particular two combinations, of different set values of upper and lower limits. With such a pressure switch, the device can be used for two kinds of applications of use, for example for cutting and air blowing. In setting the pressure for the cutting process, the pressure is set so that spray can be attached to the tool or target object. In setting the pressure for the air blowing process, the pressure is set so that the flow velocity, which is sufficient to blow off cutting powder produced during the cutting process, is secured.

According to such a pressure setting, during the cutting process, the set value for the cutting process is used, and after the cutting process, the set value for air blowing by changing the pressure switch to blow off cutting powder is used.

Furthermore, it is not always necessary to switch the set value between the pressure for cutting process and the pressure for air blowing after the cutting process. Two pairs of set values are made to be the set value for cutting process. For example, a pair of set value is made to be the set value, which is mainly intended to the set value for spraying amount and another pair of the set values is made to be set value for increasing the flow rate of gas at the discharge part. The set value for increasing the flow rate of gas results in reducing the amount of spray. This value is useful in the case where removing cutting powder is more important than spraying to the cutting part.

As one example of Embodiment 9, when the internal pressure of the container is determined with the primary pressure of 0.6 MPa, the set value for operating the pressure switch of 0.3 MPa, the hole diameter of the final exit part changing in the range from 1.0 to 4.0 mm, the variation of the internal pressure of the container is small. Thus, it is confirmed that the internal pressure of the container is stable.

Embodiment 10

FIG. 8(*c*) shows a pressure control circuit according to Embodiment 10. The pressure control circuit electrically controls the internal pressure of the container 1 and uses an electromagnetic valve 30, a pressure sensor (not shown) and a control part 31 as a pressure control means. The device of this embodiment is the same as that of Embodiment 9 in that electric control is performed by opening and closing the electromagnetic valve, but different from the device of Embodiment 9 in that the pressure switch is not used and the control part is used.

The primary supply gas from the gas source 8 is fed to the container 1 via the electromagnetic valve 30. The secondary pressure (internal pressure of the container 1) is detected by the pressure sensor and converted into the electric (voltage or current) signal. This electric signal is input into the control portion 31 and the difference with respect to the set value (voltage value or current value corresponding to the set voltage) is processed arithmetically.

The result of the arithmetic process shows that when the input signal is the set value (upper limit set value) or more, the control part 31 sends a signal to close the valve to the electromagnetic valve 30. As a result, electricity is carried to (or electricity is stopped from flowing to) the coil part of the electromagnetic valve 30, so that the electromagnetic valve 30 is closed, and thus gas supply is stopped.

When the internal pressure of the container 1 is dropped to the predetermined value lower limit set value), the control part 31 sends a signal to open the valve to the electromagnetic valve 30. As a result, flow of electricity is stopped (or carrying electricity is performed) to the coil part of the electromagnetic valve 30, so that the electromagnetic valve 30 is opened, and thus gas supply resumes.

Therefore, the internal pressure of the container 1 is maintained in the constant range by opening and closing the electromagnetic valve 30 although the cross sectional area of the exit of the discharge part 13 is changed. With such an electric control, the electric signals obtained by a pressure sensor are processed arithmetically so as to send a command to the electromagnetic valve 30 based on the signal obtained by the arithmetic processing. Consequently, necessary voltage value optionally can be set by, for example, internal voltage changing volume. In Embodiment 10, a control equipment or control software is required, so that the cost is higher as compared with the device described in Embodiment 9. However, the device of this embodiment can perform more accurate pressure control.

In the above-mentioned explanation, gas supply is performed or gas is stopped by directly opening and closing the electromagnetic valve 30, but the configuration is not necessary limited to this. For example, a valve is provided in the gas supplying path to the container 1, and this valve may be opened and closed by the electromagnetic valve. For example, an electromagnetic valve is provided in a path that is branched with respect to the gas supplying path and when the detected pressure is above the set value (upper limit of the set value) or more, the control valve 31 sends a signal to close the electromagnetic valve. Thereby, the gas supply from the electromagnetic valve to the valve of the gas supplying path is stopped and the valve of the gas supply path is closed.

When the detected pressure drops to the predetermined value (lower limit set value), the control part 31 produces a signal to open the electromagnetic valve. Thereby, gas from the electromagnetic valve resumes so as to open the valve of the gas supply path. The case was explained, in which when the valve of the gas supply path is closed, the electromagnetic valve is closed; and when the valve of the gas supply path is opened, the electromagnetic valve is opened. However, the configuration is not necessarily limited to this. The configuration in which when the electromagnetic valve is closed, the valve of the gas supply path is opened, and while the electromagnetic valve is opened, the valve of the gas supply path is closed may be employed. In this case the command signal is reversed.

As one example of Embodiment 10, when the internal pressure of the container is determined with the primary pressure of 0.6 MPa, the set value of 0.3 MPa, the hole diameter of the final exit part changing in the range from 1.0 to 5.0 mm (when it is 5.0 mm, the number of the discharging ports is two), the variation of the internal pressure of the container is smaller than that in Embodiment 9. Thus, it is confirmed that the internal pressure of the container is stable.

Furthermore, in the electric control according to Embodiment 10, by switching the set values, it is possible to use for the applications of use in accordance with set values, for example for cutting purpose and for air blowing.

Embodiment 11

Figure 9:
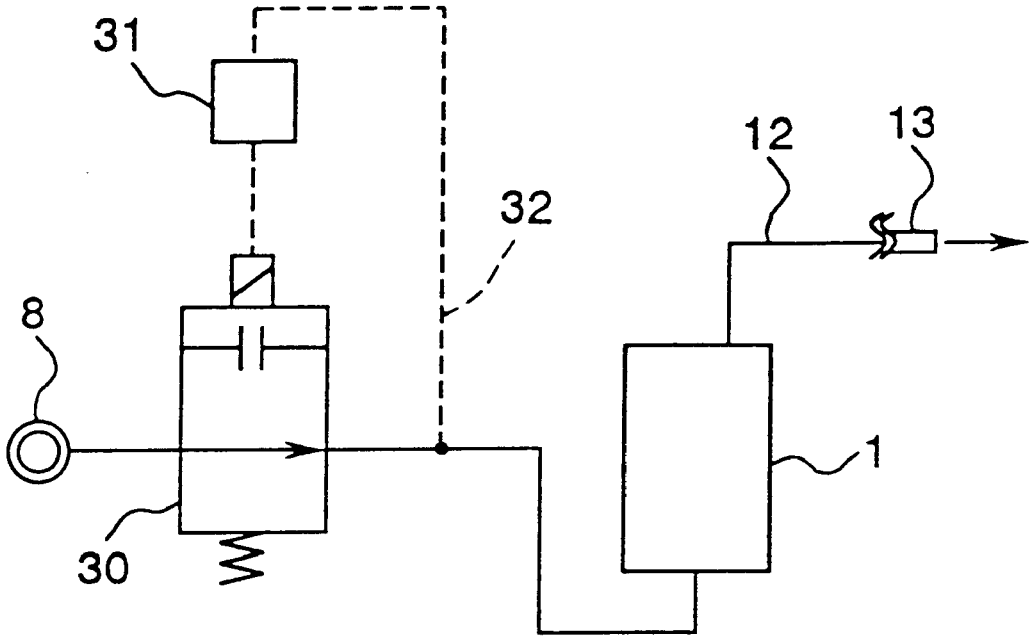
FIG. 9 shows a pressure control circuit in Embodiment 11 according to the present invention.

Embodiment 10 shows the case where the pressure is detected by the pressure sensor in the container 1 . FIG. 9 is a pressure control circuit according to Embodiment 11. In Embodiment 11, the pressure is detected in the gas supply path between the electromagnetic valve 30 and the container 1. The pressure detected in the gas supply path between the electromagnetic valve 30 and the container 1 is converted into the electric (voltage or current) signals. The electric signals are input into the control portion 31 via a path 32.

Furthermore, the pressure detection by the pressure sensor may be performed in the spray feeding outside pipe 12 between the container 1 and the discharge part 13. The arrangement of the pressure sensor is effective for the case where the feeding outside pipe 12 is too long, or it curves complicatedly, and thus the pressure loss is large.

In the above, the device provided with the pressure control means was described. For enhancing the accuracy of the internal pressure, Embodiments 10 and 11 are preferred. However, in the case where the some variation is allowed or complicated set conditions are not required, Embodiments 8 and 9 are suitable from the viewpoint of cost or simplification of equipment.

Furthermore, in a case where a plurality of gas supply nozzles into the container are present in Embodiments 8 to 11, it is necessary to provide at least one pipe path of each gas supply nozzle with a pressure control means. However, a pressure control means may be provided for a plurality of pipe paths.

Furthermore, oil supply is stopped as gas supply is stopped. With such a control, the life of the device having a movable part such as an oil supply pump can be improved. For example, in a device where oil is supplied under pulse air pressure, a pulse generator that is a source of the pulse or the electromagnetic valve is stopped as the gas supply is stopped. Furthermore, in the device in which the oil is siphoned up, the oil supply is stopped with the valve incorporated into the oil supply pipe or by the gas flow generating the negative pressure is stopped.

EXAMPLE

In Example, a device additionally including a gas discharge nozzle and an under-liquid nozzle as shown in FIG. 1 in the device shown in FIG. 5 was used. The tip of the spray feeding tube is connected to the machining center with the high speed revolution * center through specification. Furthermore, a nozzle is connected to this machining center. The experiment was carried out under the following conditions.

Container: 4 inch stainless tube (outer diameter: 114.3 mm, wall thickness: 2.1 mm, height: 250 mm)

dome member: 3 inch welded cap (outer diameter: 89.1 mm)

spray feeding tube: nylon tube (inner diameter: 9 mm×outer diameter 12 mm)

under-liquid nozzle: discharging area 3.14 $mm^2$ primary supply air pressure: 0.6 MPa (about 6 $kg/cm^2$)

spray injection nozzle: discharging area 2.26 $mm^2$ (diameter 1.7 mm)

main axis revolution number: 14000 rpm

In comparative example, the case where the air injected from the under-liquid nozzle was stopped and the case where air injected only from the under-liquid nozzle were examined. Table 1 shows the results.

TABLE 1

| | Co. Ex. 1 | Co. Ex. 2 | Co. Ex. 3 | Ex. 1 | Ex. 2 |
|---|---|---|---|---|---|
| Flow rate from injection nozzle (NL/min) | 65 | 52 | 0 | 52 | 55 |
| Flow rate from under-liquid nozzle (NL/min) | 0 | 0 | 110 | 40 | 35 |
| Flow rate from gas injection nozzle (NL/min) | 0 | 60 | 0 | 0 | 20 |
| Inner pressure of container (MPa) | 0.12 | 0.35 | 0.35 | 0.32 | 0.35 |
| State at Exit | Fume | Oil droplet | Oil droplet | Oil droplet | Oil droplet |

Co. Ex. = Comparative Example,
Ex. = Example

In Comparative Example 1, injection was stopped both from the under-liquid nozzle and the gas discharge nozzle. As a result, the internal pressure of the container was deficient, so that oil spray could not be formed into oil droplets at the tip of the nozzle connecting to the machining center and only the fume type oil could be taken out.

Comparative Example 2 was confirmed while the air flow rate from the gas discharge nozzle was increased. The internal pressure of the container was gradually increased, and when the air flow rate reached 60 NL/min, oil spray could be taken out in the form of oil droplets from the nozzle connecting to the machining center. This shows that as explained in Embodiment 1, air discharge from the gas discharge nozzle was effective for forming oil spray into oil droplets. Furthermore, as the internal pressure of the container was increased, the flow rate from the spray injection nozzle reduced by 20%. As compared with Comparative Example 1, the amount of oil spray injecting into the container was reduced.

In Comparative Example 3, air was injected only from the under-liquid nozzle. In this case, oil droplets could be taken out from the nozzle connecting to the machining center. This shows that oil spray could be produced by air injection from the stored oil.

In Example 1, air discharge from the gas discharge nozzle was stopped and the air flow rate from the under-liquid nozzle was increased. Furthermore, the flow rate from the spray injection nozzle was set to be 52 NL/min, which was the same as in Comparative Example 2. When the flow rate from the under-liquid nozzle was 40 NL/min, oil spray could be taken out in the form of oil droplet from the nozzle connecting to the machining center. Yet, visual observation showed that the flow amount was increased as compared with Comparative Example 2. The results shows that oil spray, which was produced from the liquid surface of oil, played a role as increasing the amount of the discharged oil droplet.

Example 2 was carried out while increasing the air flow rate from the gas discharge nozzle in the state of Example 1. When the air flow rate was 20 NL/min, the internal pressure of the container became the same as that of Comparative Example 2. In this state, the total flow rate (112 NL/min) of Comparative Example 2 was substantially the same as the total flow rate (110 NL/nub) of Example 2. However, the amount of oil droplet from the nozzle connecting to the machining center was larger in Example 2 by visual observation. This shows that sufficient amount of oil droplets could be secured by adjusting the air flow rate both from the under-liquid nozzle and from the gas discharge nozzle.

Industrial Applicability

As mentioned above, the liquid spray device of the present invention permits spraying liquid to the target object by feeding spray of the container, so that the device can be used as a device for supplying a cutting member of a machine tool, for example, a machining center, a grinding machine, a turning machine, or the like, with a cutting oil.

Furthermore, the cutting method of the present invention uses a device of spraying liquid to the target object by feeding the spray in the container, so that it can be used for cutting method for processing the target object by using a machining center, a grinding machine, a turning machine, or the like.

What is claimed is:

1. A cutting device, comprising a container, a spray injection nozzle for injecting oil spray into the container, and a spray feeding path for feeding the oil spray in the container to an outside of the container, wherein a gas discharge nozzle is provided having a tip portion in the air within the container and discharging gas, wherein most of the injected spray flow from the spray injection nozzle is allowed to strike a wall face in the container before being fed to the spray feeding path, and wherein the wall face is an inner wall face of a dome member opening downward.

2. The cutting device according to claim 1, wherein an inside of the container is divided into an upper space and a lower space by the wall face, and the injection port of the spray injection nozzle is located in the lower space.

3. The cutting device according to claim 1, wherein an inside of the container is divided into an upper space and a lower space by the wall face, and the injection port of the spray injection nozzle is located in the upper space.

4. The cutting device according to claim 1, further comprising a pressure control means for keeping the pressure in the container constant in the path for supplying the gas to the gas discharge nozzle.

5. The cutting device according to claim 1, wherein a tip-tapered discharge part is connected to the tip of the spray feeding path.

6. The cutting device according to claim 1, wherein gas and oil are fed to the spray injection nozzle, and the spray is injected into the container by mixing the gas and the oil in the spray injection nozzle.

7. The cutting device according to claim 6, wherein the oil stored in the container flows into a liquid supply means and the oil discharged from the liquid supply means is fed to the spray injection nozzle.

8. The cutting device according to claim 7, wherein the liquid supply means is an oil pump.

9. The cutting device according to claim 6, further comprising a pressure control means for keeping the pressure in the container constant in a path for supplying the gas to the spray injection nozzle.

10. A cutting device, comprising a container, a spray injection nozzle for injecting oil spray into the container, and a spray feeding path for feeding the oil spray in the container to an outside of the container, wherein a gas discharge nozzle is provided having a tip portion in the air within the container and discharging gas, wherein most of the injected spray flow from the spray injection nozzle is allowed to strike a wall face in the container before being fed to the spray feeding path, and wherein the wall face is an outer wall face of a dome member opening downward.

11. A cutting device, comprising a container, a spray injection nozzle for injecting oil spray into the container, and a spray feeding path for feeding the oil spray in the container to an outside of the container, wherein a gas discharge nozzle is provided having a tip portion in the air within the container and discharging gas, wherein most of the injected spray flow from the spray injection nozzle is allowed to strike a wall face in the container before being fed to the spray feeding path, and wherein the injected spray flow, after striking the wall face and before being fed to the spray feeding path, strikes another wall face formed separately from the wall face.

12. A cutting method, comprising attaching a liquid spray device to an oil supplying part of a machine tool, the liquid spray device comprising a container, a spray injection nozzle for injecting oil spray into the container, a spray feeding path for feeding oil spray in the container to an outside of the container, wherein a gas discharge nozzle is provided having a tip portion in the air within the container and discharging gas, wherein most of the spray from the injection nozzle is allowed to strike a wall face in the container before being fed to the spray feeding path, and wherein the wall face is an inner wall face of a dome member opening downward; and cutting a target object to be processed by supplying the spray to a cutting member of the machine tool.

13. The cutting method according to claim 12, wherein the inside of the container is divided into an upper space and a lower space by the wall face, in which the injection port of the spray injection nozzle is located in the lower space.

14. The cutting method according to claim 12, wherein the container is divided into an upper space and a lower space by the wall face, in which the injection port of the spray injection nozzle is located in the upper space.

15. A cutting method, comprising attaching a liquid spray device to an oil supplying part of a machine tool, the liquid spray device comprising a container, a spray injection nozzle for injecting oil spray into the container, a spray feeding path for feeding oil spray in the container to an outside of the container, wherein a gas discharge nozzle is provided having a tip portion in the air within the container and discharging gas, wherein most of the spray from the injection nozzle is allowed to strike a wall face in the container before being fed to the spray feeding path, and wherein the wall face is an outer wall face of a dome member opening downward; and cutting a target object to be processed by supplying the spray to a cutting member of the machine tool.

16. A cutting method, comprising attaching a liquid spray device to an oil supplying part of a machine tool, the liquid spray device comprising a container, a spray injection nozzle for injecting oil spray into the container, a spray feeding path for feeding oil spray in the container to an outside of the container, wherein a gas discharge nozzle is provided having a tip portion in the air within the container and discharging gas, wherein most of the spray from the injection nozzle is allowed to strike a wall face in the container before being fed to the spray feeding path, and wherein the injected spray flow, after striking the wall face and before being fed to the spray feeding path, strikes another wall face formed separately from the wall face; and cutting a target object to be processed by supplying the spray to a cutting member of the machine tool.

17. A cutting device, comprising:

a tool; and an oil supply system for the tool, including:

a container;

a spray injection nozzle for injecting oil spray into the container; and a spray feeding path for feeding the oil spray in the container to an outside of the container;

wherein a gas discharge nozzle is provided having a tip portion in air within the container and discharging gas, wherein most of the injected spray flow from the spray injection nozzle is allowed to strike a wall face in the container before being fed to the spray feeding path, and wherein the wall face is an inner wall face of a dome member opening downward.

18. A cutting device, comprising:

a tool; and an oil supply system for the tool, including:

a container;

a spray injection nozzle for injecting oil spray into the container; and a spray feeding path for feeding the oil spray in the container to an outside of the container;

wherein a gas discharge nozzle is provided having a tip portion in air within the container and discharging gas, wherein most of the injected spray flow from the spray injection nozzle is allowed to strike a wall face in the container before being fed to the spray feeding path, and wherein the wall face is an outer wall face of a dome member opening downward.

19. A cutting device, comprising:

a tool; and an oil supply system for the tool, including:

a container;

a spray injection nozzle for injecting oil spray into the container; and a spray feeding path for feeding the oil spray in the container to an outside of the container;

wherein a gas discharge nozzle is provided having a tip portion in air within the container and discharging gas, wherein most of the injected spray flow from the spray injection nozzle is allowed to strike a wall face in the container before being fed to the spray feeding path, and wherein the injected spray flow, after striking the wall face and before being fed to the spray feeding path, strikes another wall face formed separately from the wall face.

* * * * *